US008689695B2

(12) United States Patent
Burdine et al.

(10) Patent No.: US 8,689,695 B2
(45) Date of Patent: Apr. 8, 2014

(54) AREA DENIAL DEVICE

(76) Inventors: Robert Van Burdine, Ardmore, TN (US); Dorothy Devine Burdine, Ardmore, TN (US)

( * ) Notice: Subject to any disclaimer, the term of this patent is extended or adjusted under 35 U.S.C. 154(b) by 163 days.

(21) Appl. No.: 13/372,192

(22) Filed: Feb. 13, 2012

(65) Prior Publication Data

US 2013/0206028 A1 Aug. 15, 2013

(51) Int. Cl.
*F42B 22/02* (2006.01)

(52) U.S. Cl.
USPC ..... 102/424; 102/401; 102/428

(58) Field of Classification Search
USPC ..... 102/401–429; 588/403
See application file for complete search history.

(56) References Cited

U.S. PATENT DOCUMENTS

| | | | | |
|---|---|---|---|---|
| 1,670,078 | A * | 5/1928 | Pratt | 102/414 |
| 2,805,067 | A * | 9/1957 | Ryan | 473/570 |
| 3,964,392 | A * | 6/1976 | Kintish et al. | 102/404 |
| 5,904,443 | A * | 5/1999 | Soleau | 404/6 |
| 2003/0133758 | A1 * | 7/2003 | Dever | 405/259.6 |
| 2012/0186479 | A1 * | 7/2012 | Skidmore et al. | 102/364 |
| 2013/0068122 | A1 * | 3/2013 | Mitchell | 102/401 |
| 2013/0206028 | A1 * | 8/2013 | Burdine et al. | 102/424 |

* cited by examiner

*Primary Examiner* — Samir Abdosh

(57) ABSTRACT

A propelled lance provides a wounding non-lethal anti-insurgent action when stepped on by piercing an enemy insurgent's foot with a lance penetrator. The lance penetrator lodges in the foot and further penetration is impeded by a stop plate. The lance penetrator may insert an RFID or other identifiable device or other payload into the insurgent. The lance penetrator provides anti-personnel, anti-vehicle and anti-robot action.

15 Claims, 26 Drawing Sheets

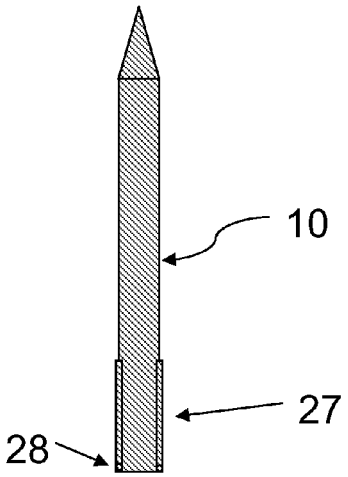
FIG. 14A
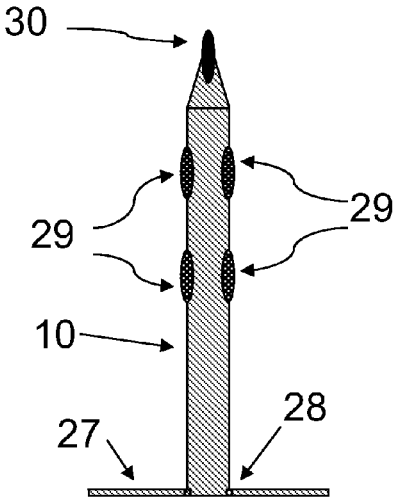
FIG. 14B
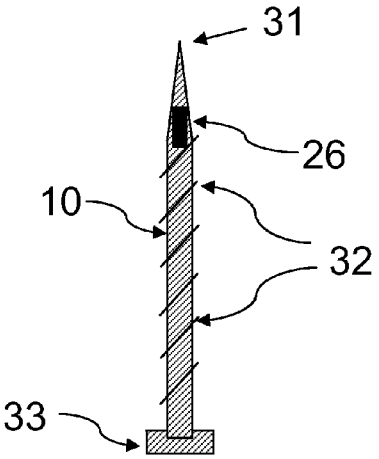
FIG. 14C
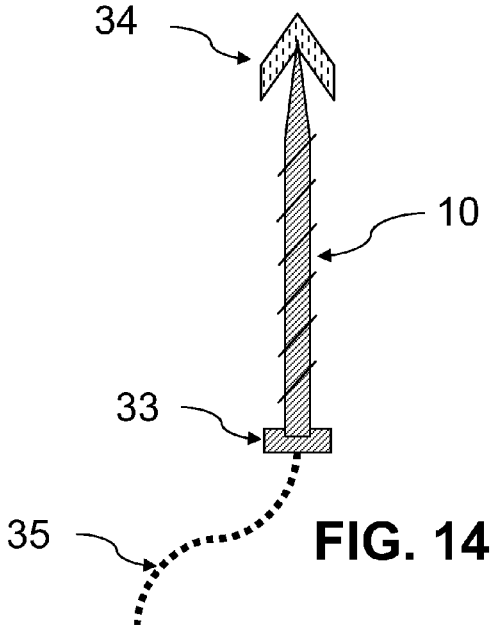
FIG. 14D
FIG. 14

AREA DENIAL DEVICE

FIELD OF THE INVENTION

The present invention relates to defense means, particularly to the field of non-lethal area denial devices, and to non-lethal devices for disabling, RFID tagging and marking enemy personnel, vehicles and robots. The present invention relates to devices such as land mines and other area denial devices that, after deployment, are armed or arm themselves through the action of an integrated component, and later are disarmed or disarm themselves through a similar process.

SUMMARY OF THE INVENTION

The following description of preferred embodiments will provide a summary description of the present invention.

Explosive anti-personnel landmines cause thousands of deaths and severe, life limiting injuries amongst insurgents and civilians every year. It is estimated that over 20,000 civilians, including many children, are permanently maimed or killed a year by anti-personnel landmines. As a result of wide-spread international concern about the high number of civilian injuries and deaths from these mines, there is general agreement among many Governments that it is necessary to restrict and eliminate these weapons. This has resulted in an international treaty known as the Ottawa Convention to ban explosive Anti-Personnel Landmines.

The United States is not at this time a signatory party to this treaty, and the United States military and most other military forces see the continuing need to deny enemy access to areas or to delay access until troops can occupy and mount defenses. The United States has maintained that United States anti-personnel mines are not the cause of civilian casualties since the anti-personnel mines in United States mine systems are intended to self-destruct during or shortly after combat.

The need for anti-personnel landmines will never go away. It is highly desirable to deny an enemy access to an area during battle. It is also highly desirable to deny access to approaches to camps and fortifications, both on a long and short-term basis. With an explosive anti-personnel landmine, the possibility of civilian injury and death is very high. The possibility of accidental injury or death to friendly forces is also high, both in the deployment and recovery of the landmine.

With the present invention landmine replacements can be deployed that are non-lethal yet pose a serious threat of injury and provide a strong deterrent to enemy personnel entering the area. These lance mines will cause a painful and temporally disabling injury, and provide options for tagging enemy personnel for identification. These lance mines provide for the use of electrical, chemical and biological means to have a further deterrent on the enemy personnel as desired.

The present invention provides a lance mine that will cause a non-lethal injury to enemy personnel by means of a spike penetrator that will pierce the body at the point of contact. The lance mine does not accomplish its deterrent action by exploding, but by driving a spike penetrator into the insurgent's foot. The spike penetrator will cause severe pain at the point of entry, but will not penetrate far enough to be life threatening. Further, the spike penetrator can be facilitated with an identification device, such as a Radio Frequency Identification Device, known generally as an RFID chip, that is inserted into the body of the enemy personnel and remains in the body of the enemy personnel even if the enemy personnel pulls the spike penetrator out. Other identification devices include those comprised of metal, magnetic material, radioactive material, biologicals, chemicals, drugs, paper, plastic, ceramic, glass, wood, or organic materials.

The spike penetrator is shaped and surfaced such that it will make ready entry into the body, and resist attempts to remove it by simply pulling or tugging. The spike penetrator may be ribbed or roughened, or barbed, or may have a shaped surface that requires expansion of the wound to facilitate removal. The spike penetrator may also be shaped as a screw. Any attempt to remove it could be easily complicated by making the shape a left hand screw, such that when an uninformed person attempts to remove the screw shaped penetrator the right hand turning action will simply drive the spike penetrator deeper into the foot of the enemy personnel. Spike penetrators that are thus shaped will discourage casual attempts at removal, and specialized tools for removal may be provided to authorities to encourage the enemy personnel to quickly surrender and seek medical attention.

The spike penetrator may also be equipped with an adhesive surface such that upon entry it rapidly 'glues' itself in place, forming a bond with the flesh of the enemy personnel and denying easy removal. For example, a fast acting cyanoacrylate coating on the spike penetrator would cause the spike penetrator to seal itself into the wound, eliminating the possibility of blood loss and reducing the possibility of removing the spike penetrator without medical attention. Any inserted RFID chip could be so equipped to prevent non-professional removal.

The lance mine will be relatively silent in its operation as the spike penetrator is directly impacting and penetrating the boot, and the expanding gas noise is muffled by the boot standing directly on top of the lance mine.

Chemicals such as irritating and inflammatory agents may be attached to or embedded as an integral part of the spike penetrator. Agents such as pepper derivates (Oleoresin Capsicum and related compounds), alcohols, ketones, solvents, oils, mustards, halogenated organic compounds, metals, organics, inorganics, minerals, cyanoacrylates, and histamine producing or initiating compounds may be used to increase the discomfort level and encourage the enemy personnel to seek immediate medical attention.

Thermal agents may be incorporated that rapidly increase the temperature of the spike penetrator, and in this manner will encourage the enemy personnel to immediately cease battle activities. A pyrotechnic whistle or small explosive report may be incorporated in the lance mine or spike penetrator to alert friendly personnel to the proximity of a triggered lance mine.

Electrical agents, such as a battery powered device providing electrical shock, or a mechanical vibrator providing mechanical stimulation, may be integrated into the lance mine and spike penetrator to facilitate inhibitory action against the enemy personnel.

Drugs such as sedatives, tranquilizers or other inhibiting or stimulating medications may be incorporated for spike penetrator delivery. In this manner, the enemy personnel are disabled for ready apprehension.

Dyes, drugs or biological agents may be introduced that dye the skin of the enemy personnel for ready identification. As these dyeing agents are internal and systemic, they will be impossible to simply wash off as with externally applied agents. In the case where the penetrator is targeted against enemy personnel wearing shoes or boots, the penetrator may be so contrived as to penetrate the shoe and foot with a final mechanical stop, such as a nail or screw head, to stop the penetrator from passing completely through the shoe and therefore attaching or fastening the shoe to the foot.

Biological and chemical agents may be incorporated into the spike penetrator. Materials that produce an undesirable condition may be introduced in this manner. By equipping the spike penetrator in such a manner and providing an attached notice with instructions as to where and in what time period to seek proper medical attention, the enemy personnel will be highly encouraged to surrender to the designated authorities. Intelligence and other information gathering may be positively augmented in such a manner.

In all the possible incorporations and modifications of the spike penetrator and lance mine, it is always optional to have the lance mine and spike penetrator remain mechanically together, have the spike penetrator and lance mine attached using chain, wire, rope, fiber, cable, lanyard or other connecting medium to connect the spike penetrator to the buried lance mine, or have the lance mine and spike penetrator completely separate upon action. The spike penetrator and lance mine may be comprised of metal, non-metal, plastic, wood, stone, glass, ceramic, chemical agent, combination of chemical agents, or any material with properties sufficient to accomplish the penetration function.

The lance mine may power the spike penetrator by pyrotechnic propellant, propelling explosive, compressed gas, pyrolytic action, mechanical spring, gas spring, or mechanical action resulting from the pressure exerted by the enemy personnel against the mine. The present invention may be electronically equipped such that it may be remotely shut down and rearmed as desired.

The lance mine may be initiated by mechanical or pyrolytic action, or by remote control when so equipped. The lance mine may be fully electronically equipped for command, condition reporting and control as desired. The lance mine may be equipped with electronic proximity fuses for initiation.

The detonator, initiator, firing pin, shearable or breakable component, or other firing mechanism of the present invention may be made pressure sensitive such as to differentiate between the weight of a tank or other vehicle and that of enemy personnel, and made to detonate only at the weight range of enemy personnel.

It has been proposed to place landmines along border areas to reduce or prevent the crossing of illegal immigrants, drugs, and terrorists. Opponents have indicated that landmines kill or seriously maim, and that such severe injury is unreasonable for this situation. The present invention offers a painful but non-lethal deterrent, and a clear and reliable capability of identifying the injured personnel as illegal personnel.

After military missions or actions have been completed, it is often important to neutralize or deactivate mines in order to ensure that civilian personnel or friendly personnel are not harmed by munitions that have not been activated by enemy forces. It is an object of the present invention that the lance mine be equipped to self sterilize and deactivate at a predetermined time by the action of integrated chemical components.

By equipping the lance mines of the present invention with an embedded RFID chip, the lance mines can be easily cataloged and identified if removal ever becomes necessary. The RFID chip that is imbedded in an enemy personnel may be matched with the RFID of the delivering lance mine providing an exact location of the enemy personnel at the time of the lance mine activation. A single RFID in the spike penetrator may be used for both purposes.

It is an object of the present invention to provide a chemical device that operates independently and requires no battery and no additional intrusion detection sensors. It is a further object of the present invention to provide an anti-personnel lance mine that does not cause injury by explosive shock.

The lance mine of the current invention is anti-personnel in nature, but does not produce a large explosion to incapacitate or kill the enemy personnel. The lance mine effects a deterrent action by driving a spike penetrator into the enemy personnel where, with certain preferred embodiments herein described, achieves by a variety of methods the incapacitation and deterrent of the enemy personnel to continue with the battle. The present invention is both incapacitating and nonlethal in its nature. The enemy personnel is placed in a position of requiring immediate and specialized medical attention, thereby encouraging the enemy personnel to leave the battlefield or surrender, all without the endangerment of life or property.

It is an embodiment of the present invention that should the lance mine accidentally activate during transportation, placement, or recovery, that injury to friendly personnel upon said activation can easily be avoided with simple technique and safety precautions.

The need for munitions such as mines and other devices placed or buried upon land to be safely placed and then rendered safe after a certain period of time is of great importance to the military. After military missions or actions have been completed, it is often important to neutralize or deactivate such mines in order to ensure that civilian personnel or friendly military personnel are not harmed by munitions that have not been activated by enemy forces. Because it is inherently unsafe to attempt to neutralize or deactivate such munitions, a great deal of effort has been put towards munitions that self-destruct or deactivate after a certain period of time has elapsed. There are problems associated, however, with placing a standard timer and actuator system within the mines, and any standard timer would require power to operate. This could be potentially unsafe, subject to failure and would allow such mines to be more easily detected. Therefore, the development of a simple interval timer and actuator system requiring no external power is necessary to accomplish this goal.

The present invention provides means by which it can be deployed in a safe or disarmed condition, and after deployment convert itself into an armed state through interaction with the environment. It is a further object of the present invention that the munition converts itself to a safe or disarmed condition at a later time through interaction with the environment. It is a further object of the present invention that the munition is recoverable, and that the recovered munition is reworkable into a condition suitable for redeployment.

The present invention is a propellant driven lance, such as a spike, that can incapacitate an insurgent as effectively as an anti-personnel landmine without inflicting death or life limiting injury.

A propellant powered spike provides a non-lethal anti-insurgent action on activation by piercing an enemy insurgent's foot with a spike penetrator. The spike penetrator may be equipped to insert an identifiable device or other payload into the insurgent's foot. The spike may be equipped for anti-vehicle and anti-robot action.

The spike penetrator is mounted in a propellant pressurizeable tube and is equipped to fire when stepped on. The propellant pressurizes the tube and propels the spike penetrator into the foot with enough force to overcome a shoe or boot sole, and enough force to overcome boot armor as desired. The spike penetrator is designed to stop in the boot or shoe sole or the bottom of a bare foot. When the lance mine is equipped for higher penetrating force, such as might be used against heavily armored boots, the lance mine tube may be further equipped with a pickup washer that is picked up on the propellant chamber shoulder of the spike penetrator and carried forward to increase the load distribution thereby stopping the spike penetrator at the proper position even in a bare foot. It is an embodiment that the spike penetrator can penetrate heavy armored boots and still stop in the correct position limiting injury to a barefoot civilian.

When the spike penetrator stops in a boot sole it effectively 'nails' the boot to the foot. The penetration of the foot by the lance causes immediate incapacitation of the insurgent and limits their ability to walk or function. The spike penetrator may also be tethered holding the insurgent in place using chain, wire, rope, fiber, cable or other connecting medium to connect the spike penetrator to the buried lance mine or other secured means. The puncture wound produced by the spike penetrator may be selected such that blood loss is restricted. With medical care, the spike penetrator can be extracted and the insurgent will have been removed from the battle in an effective manner without sustaining life limiting injury or death. In a similar manner civilians that step on and initiate the present invention will experience incapacitation but will not sustain life limiting injury.

The force required to fire the lance mine can be predetermined such that the weight of the anticipated target must be achieved before the lance mine will fire. It is an embodiment of the present invention that the force necessary to trigger the lance mine can be set at the time of manufacture. In this manner, a lance mine targeted for an adult insurgent would not fire when stepped on by a small child, and a lance mine intended for a heavier vehicle or robot would not fire when stepped on by an insurgent.

With the present invention area denial devices can be deployed and distributed while in a condition that prevents their initiation. This safe condition is temporary and will move to an armed condition in a predetermined or controlled time. The area denial device is then sensitive and may be easily initiated in a manner inherent to its design. After a predetermined or controlled time the area denial device will revert to a safe condition. The area denial device can then be abandoned in place or retrieved and reworked to once again be a deployable area denial device.

If a tire, such as a truck or automobile tire, runs over and initiates the lance mine, the fired spike penetrator will penetrate the tire much as a common nail and will remain in the tire. If the spike penetrator is RFID equipped the tire can be tracked and located. Alternatively, the spike penetrator can be equipped with means to allow the air to escape from the tire disabling the vehicle.

Anti-robot mines have not been disclosed as it is assumed an explosive mine will destroy or disable a robot. Robots can be designed to survive external explosions and the skin of a robot can deflect Electro Magnetic Pulses (EMP) around its sensitive electronics. The present invention penetrates the robot skin and can optionally explode producing high pressure inside the robot; can inject corrosives, acids, or adhesives inside the robot; can produce an overvoltage pulse or an EMP inside the robot; or can do all three. The present invention can lodge the lance into the robot's skin and tether the robot in place using chain, wire, rope, fiber, cable or other connecting medium to connect the spike penetrator to the buried lance mine or other secured means.

The arming and disarming processes of the present invention are accomplished through the use of environmentally reactive materials in the construction of the device. These reactive materials are structurally situated to act as retainers at selected mechanical release points. When these reactive materials react with environmental components they become non-structural and the component being retained comes apart or otherwise changes its functional arrangement to accomplish the desired condition of armed or unarmed. Alternatively the component itself may be constructed of an environmentally reactive material and the reaction that proceeds on exposure to the environment reacts the entire component to a nonstructural condition resulting in its failure and the accomplishment of the desired condition of armed or unarmed.

For example, by using a retaining ring assembly such that the detonator can not move, and therefore not operate, and by arranging the structure of that ring to be secured by selected reactive materials, then when the reactive materials release, the retaining ring assembly will fall or otherwise move away and the detonator mechanism will then be free to operate. In this manner the munition has transformed from a safe or disarmed condition to an armed condition.

In another example, the firing pin being retained as a whole and functional component secured by selected structural reactive materials, and said materials reacting at a predetermined interval such as to become nonstructural and release the retainment of the firing pin, the firing pin then becomes inoperative and the munition moves from an armed to a disarmed state.

In another example, the firing pin spring is retained by selected structural reactive materials, and said materials reacting at a predetermined interval such as to become nonstructural and release the retainment of the spring, the spring then expands and becomes inoperative and the munition moves from an armed to a disarmed state.

In another example, the retaining pin degrades and allows the penetrating spike initiator to contact the bottom of the lance mine tube, initiating the propellant charge and expelling the spike penetrator thereby deactivating the lance mine.

In another example, a retainer ring is made entirely of a reactive material that is structurally sound, and upon exposure to the environment the reactive material of the retainer ring becomes nonstructural and crumbles away causing a change of state between armed or disarmed in the munition.

In another example, the environmental seal fails after a given time and the initiator is optionally fired expelling the penetrator spike or degrades such that it will not fire.

By these means the area denial device or other munition can transform itself from safe to armed and back to safe. The area denial device can be safely recovered and reconfigured to a deployable state or abandoned as desired.

It is intended that the present invention will utilize one or more of the many different structural but environmentally reactive material possibilities to arm and disarm a munition or other area denial device, and the selection of a particular geometry will depend largely on the design of the munition.

It is an embodiment of the present invention that environmentally reactive materials are used to serve as attachment points and connecting members to secure the action of structural components of the munition. In this manner, the amount of material used will be minimized and the economic cost of making and refurbishing the munition lowered.

It is an embodiment of the present invention that the reactive materials, through interaction and reaction with environmental, factors, fail and transform the structural components into subcomponents that no longer perform the original function.

It is an embodiment of the present invention that the reactive materials have a known and predictable interval from initial exposure to the environment to the time of their structural failure as an attachment point.

An attachment point may be any type of structure including but not limited to rods, points, wires, brackets, bonds, sets, glues, lines, spheres, fasteners and other shapes and functions as desired. Attachment points may be comprised of a variety of chemical components wherein one of more are reactive with the environment and precipitate the desired change.

Environmental factors for the present invention include air, water, soil, sand, temperature, darkness, light, humidity, dryness and sunlight.

Reactive materials, for the purpose of the present invention, are defined as those substances which can, in contact with air, water or other environmental factors, experience or initiate a chemical change that results in their structural failure as an attachment point or component.

It is an embodiment of the present invention to use materials reactive with air. Air reactive chemicals are chemicals which react in contact with environmental air containing oxygen or with compounds containing oxygen. Air reactive chemicals that are spontaneously combustible are known as pyrophoric materials. Examples of air reactives are the alkali metals including lithium, sodium, potassium, rubidium, cesium and francium. The alkali metals form ionic solid oxides of composition M2O when they react with air. Sodium also forms the peroxide Na2O2 as the main product, and potassium forms the superoxide KO2, also as the main product.

The alkali metals and their compounds also react with atmospheric water vapor and liquid water. In contact with water they react with it to produce hydrogen and alkali hydroxides such as 2M(solid)+2H2O(vapor)>>2M(aqueous)+2OH(aqueous)+H2(gas). Alkali metal hydroxides are white ionic crystalline solids of formula MOH, and are soluble in water.

Finely divided metal dusts of nickel, zinc and titanium, and dendritic forms of these metals are useful as reactive materials and are preferred materials in the present invention. They; along with the hydrides such as barium hydrides, diborane, diisobutyl and aluminum hydrides; will react with oxygen in air and atmospheric moisture to form unstable bonds and structures. Air reactive materials also include the oxidizable metals in general, organic and inorganic materials, and materials that sublimate in air such as naphthalene and organometallic compounds such as nickelocene.

It is an embodiment of the present invention to use materials reactive with water, either as vapor, humidity, steam, condensate or liquid. Water reactive chemicals are chemicals which react in contact with environmental water. Water reactive materials react when in contact with water, wet surfaces, or even the moisture in the air. Examples and embodiments of the present invention include the alkali metals, anhydrides (such as acetic anhydrides), carbides (such as calcium carbide), halides (such as acetyl chloride, titanium chloride, stannous chloride and other salts), hydrides (such as sodium hydride), organometallics (such as tetramethyl aluminum and nickel carbonyl), oxides (such as sodium and calcium oxides), peroxides (such as sodium and barium peroxide), phosphides (such as aluminum, calcium and copper phosphide) and others such as chlorosulfonic acid and aluminum tribromide. Reactive materials with water also include all sugars and other water soluble organics, water soluble inorganics, and hygroscopic salts. Metals such as iron and zinc react with water and transition from structural metals to nonstructural oxides. All of these materials, when used as a reactive system or a thin film, can be accurately and reliably predicted to fail at a given interval after environmental exposure.

Peroxides, and materials that can form peroxides upon exposure to the environment, are useful when combined with otherwise stable materials as interval timers. Examples include the ethers such as isopropyl ether, ethyl ether and diethyl ether. It is an embodiment of the present invention that peroxides, peroxide producing materials, and materials combined with peroxides and peroxide producing materials form a desirable group of structural combination materials for use in the present invention.

Polymers and their associated polymerizers such as acrylic acid, butadiene, cyclopentadiene, ethylene, styrene (vinyl benzene), and vinyl chloride are useful when the exposure to air is controlled for the transition of structural plastics into a nonstructural material that easily crumbles. Several types of reactive plastics are applicable to the present invention. Plastic compositions consisting of ethylene-vinyl and polyvinyl alcohol, and similar compounds are readily reacted from structural materials to nonstructural materials by the action of sunlight and temperature. Cellulose-based resins and combination materials also represent an effective material choice for this invention. One skilled in the art of reactive plastics can provide a formulation offering the appropriate degree of structural to nonstructural transition depending upon the environmental and performance characteristics desired.

Melting point linkages made of materials such as Wood's metal (melting point 158 degrees F.), Cerrolow 117 (melting point 117 degrees F.) and waxes among other thermally reactive materials are useful in initiating a structural to nonstructural linkage change based on temperature. Land mines set to arm at temperature that are placed in the late winter could deny walking and other routes to an enemy moving in early spring or summer. The expansion of water changing to ice could be useful in initiating a thermally activated state change.

To safeguard against the premature initiation of the reactive process, munitions in storage, transport or those awaiting use in the field should be protected from environmental influences. This is readily and inexpensively addressed by employing enhanced environmental protection in their shipping containers and in the munitions packaging. It is an embodiment of the current invention that the reactive materials are packaged such that their exposure to reactive environmental factors be controlled and exactly known during deployment.

While the method of this invention has been shown and described with reference to specific embodiments it will be understood by those skilled in the art that many deviations, derivations and variations in form and specific details may be made therein without departing from the scope of the invention which is limited only by the claims annexed hereto.

DISCUSSION OF THE PRIOR ART

Historically, unexploded munitions have posed a serious threat to military and civilian personnel. Once located, the generally employed method of dealing with these dangerous devices is to detonate them where they lie or to transport them to a safer location for detonation or burning. Destruction is typically accomplished by placing explosive charges among the unexploded ordnance items and then initiating the explosion and ensuing destruction from a safe distance. Devices too dangerous to handle or transport, such as armed mines, may be neutralized by overcrossing the area with rollers or dragging chains. This is an expensive and time-consuming procedure, and one which normally requires re-working the area with heavier follow-up rollers to destroy deeper laid devices and to confirm the effectiveness of the neutralization process prior to returning the land to general use.

To facilitate the identification and neutralization of unexploded ordnance a number of methods have evolved. One, as described in U.S. Pat. No. 4,711,179 embodies a land mine which, upon deployment in an armed state will, after a predetermined length of time, disarm itself and eject a marker to identify the location of the disarmed mine. The disarming mechanism and the spotting charge used in the ejecting stage require numerous electronic and mechanical components, including a timer, battery, and motor. These items increase the expense and complexity of the munition. Additionally, the highly visible marker is more likely to be discovered by enemy forces than not.

U.S. Pat. No. 6,629,499 describes a mechanical timer device that depends upon ambient temperature fluctuations to count down and is used to render safe a mine or other ordnance device after a certain period of time. Repetitive temperature flux is questionable, or at least limits the environment in which the mine timer can operate, and the large amount of metal makes the mine easy to find by standard techniques.

U.S. Pat. No. 3,447,461 reveals an antipersonnel mine which is self-neutralizing through the utilization of an internal water reservoir or through the admission of atmospheric moisture to the interior of the device via numerous apertures. The dispersion of the moisture within the confines of the mine causes a suitable medium to become engorged and enlarged, thus initiating a series of events culminating in the movement of an obstruction between the firing pin and the detonator.

A deactivation means is incorporated into the design offered in U.S. Pat. No. 3,464,354. The disarming mechanism relies upon the device's loss of pressurization over time. The time interval for the deactivation is not known. Deactivation relies upon the assumption that a permanent air pressure seal is unachievable. The premise is that once deployed, the device's pressurization will last no longer than a few years. The pressurization is also the force used to drive the firing pin into the detonator. Consequently, once pressure is lost, there no longer exists the required energy to propel the firing pin; and the device becomes deactivated. This device leaves behind a significant amount of explosive material whereas the present invention does not contain significant explosive material.

U.S. Pat. No. 6,014,932 describes a mine that can be remotely armed after placement. The patent describes a system for remotely arming a land mine via satellite or an airborne vehicle, and a corresponding method. This added expense for communication, command and control will significantly increase the cost of the munition.

U.S. Pat. No. 3,667,387 discloses a self-destructing land mine. The self-neutralizing process is initiated by the rupturing of internally contained glass vials containing a solvent. This solvent reacts with a nitrocellulose outer film. The eventual dissolution of the nitrocellulose film causes the confined phosphorus to become exposed to the atmosphere, thus initiating the violent destruction of the mine. This land mine is so dangerous that it must be stored and transported submerged in water. Otherwise, should one or more of the internal glass vials rupture, the ensuing atmospheric exposure of the phosphorus will have catastrophic results. Logistically, it is unrealistic to transport large quantities of this device in a hostile environment while maintaining them submerged in water.

Another method of eliminating the dangers of unexploded ordnance is described in U.S. Pat. No. 4,493,239. The patent discloses a process of enhanced oxidation of buried aluminum and ferrous ordnance through the establishment of a continuous flow of direct current electricity through the soil medium. This continuous flow of electricity may be enhanced through the constant saturation of the ground up to a depth of three feet with a saline solution to enhance the oxidation process. Completion of the process may take up to ten years. This prolonged process is impractical for use in most locations and prohibitively expensive where it could be employed. The present invention does not contain an explosive and is very small having little effect on the land once it is abandoned. It causes immediate injury that the affected person will have to recover from but with medical attention will not cause life altering injury or death.

Electronic munitions that self destruct at the end of their battery life are also known. Devices of this type are usually expensive and are readily detected due to their electronic emissions and battery mass.

The need for an effective and self arming/disarming munition is exemplified by the proliferation of attempts to produce self-neutralizing anti-personnel ordnance. Under the present invention, a simpler, more efficient, reliable, and less costly method of achieving this end is disclosed.

It has been a matter of considerable effort to devise an effective landmine that at the same time can be rendered harmless. More recent work has centered on nonlethal mines that repel or mark an enemy personnel.

In 1999, the Ottawa treaty went into force to prohibit the use, stockpiling, production and transfer of explosive anti-personnel landmines. The U.S. did not sign this treaty as it desires to use anti-personnel landmines in military operations. It is widely understood that the U.S. wants to be able to be compliant with the Ottawa treaty. The dilemma is how to preserve the effectiveness of minefields while eliminating the explosive anti-personnel landmine.

To achieve this desired outcome many technologies have been proposed.

U.S. Pat. No. 6,640,721 describes a non-lethal airbag munition which can be used alone or in combination with anti-tank landmines to prevent target pedestrians and vehicles from entering a specific area or following a particular route for a period of time is disclosed. The munition can inflict severe ankle and foot injuries to target pedestrians but discriminates based upon the weight of the target. This method may or may not remove an insurgent from the battle. This method produces injury that may or may not incapacitate the subject personnel. In addition, injury levels may include ankle or knee damage that may be a life altering injury. The present invention initiates a simple puncture wound which, even if through a joint or bone, with prompt medical attention the personnel should expect a full recovery.

U.S. Pat. No. 5,936,183 describes a non-lethal alternative to the anti-personnel landmine. The TASER® alternative uses electronic stun capability in combination with a landmine housing and deployment system. The device can cover a radius of 15 feet (30 feet possible) and can be triggered by various sensors. Although the TASER® non-lethal area denial device would cause no deaths or injuries if accidentally triggered by friendly forces, it can also be permanently disabled when no longer needed, by remotely using a secure code to shut down the TASER® system. When triggered, the device launches darts in multiple directions at 10 or 20 degree intervals in a direction generally facing the enemy. The darts temporarily incapacitate any persons within an inch of the darts by causing uncontrollable spasms of the near surface motor control muscles causing temporary loss of the subject's motor control functions. The subject will fall and temporarily be completely incapacitated. The device will take down persons wearing soft body armor because high voltage electricity readily arcs through the fabric weaving holes. A timing circuit keeps the subjects incapacitated until they can be taken into custody by nearby troops. After the very low power signal is turned off, the subject will recover within minutes. The TASER® device produces no collateral damage and poses no lethal threat to friendly forces even if accidentally triggered. The TASER® does nor produce an injury that would remove an insurgent from the battlefield. While the experience may be undesirable, the insurgent will make a rapid recovery and return to the fight within minutes of the event. The device may be remotely shut down permanently via an encrypted security code. The present invention may also be remotely shut down permanently or temporarily via an encrypted security code. The present invention also produces no collateral damage and poses no lethal threat to friendly forces even if accidentally triggered. The present invention has the advantage of causing painful and debilitating injury causing the enemy personnel to be removed from the battlefield. The affected personnel will require specialized and immediate medical attention and will be unfit for combat for an extended period of time. Knowledge that the lance may be specialized in some manner such as incorporating an RFID chip that requires specialized medical attention may give cause for affected enemy personnel to surrender themselves to the proper authorities providing the opportunity for intelligence gathering.

U.S. Pat. No. 7,458,321 describes a non-lethal anti-personnel landmine comprising a sealed container having a first chemical reactant contained therein, and a second container having a second chemical reactant contained therein, the container being positioned within the mine to assure that a stepping action on the mine will result in the opening of the container and the release of the contents thereof into contact with the second chemical reactant, whereby the contact results in a fast chemical reaction non-lethal to the person stepping on the mine. This chemical reaction will get hot, smoke, make a noise, emit light, release an irritant or release a dye. These actions may or may not cause the enemy personnel enough of an injury to require removal from the battlefield. The present invention will incapacitate the enemy personnel in a nonlethal manner, and will necessitate the enemy personnel be removed from the battlefield and seek medical attention at once.

U.S. Pat. No. 7,137,340 describes the Mixed Mine Alternative (MMA) System. This system is a tilitary system designed for use in mechanized warfare. The MMA System has three components, MMA smart Antitank mines, MMA Antihandling Sensors linked to the MMA smart Antitank mines, and MMA Remote Control Units (RCU). The MMA smart Antitank (AT) mines contain a primary sensor system hardened against countermeasures and a kill mechanism similar to existing scatterable AT mines. The MMA AT mine is capable of transmit and receive communications with a Remote Control Unit and with the MMA Antihandling Sensors (AH). The communications capabilities and processors in the MMA AT and the MMA AH allow the system to establish MMA AT to MMA AH links after the mines have been scattered. MMA AT will be linked to MMA AH that are within their lethal radius. The MMA AT mine processors allow the mine primary antitank sensor to be on or off. The mine may receive and act on detonate instructions from the primary antitank sensor, from the antihandling sensors, or from the MMA RCU. If in an off status the MMA AT mine may relay the detonate signal received from an MMA AH sensor to the RCU. The RCU includes a computer that maintains status information on the mines. Receipt of a relayed AH sensor detonate signal provides situational awareness information that the RCU brings to the user's attention on the screen and with an audible and/or visual signal. Essentially this system uses sensors that cause the antitank landmine to explode as a result of sensors detecting enemy personnel. This may not satisfy the requirements of the Ottawa Treaty. The present invention directly substitutes for explosive anti-personnel mines that protect anti tank landmines, wherein an enemy personnel stepping on the lance will initiate the anti-personnel penetrator and sustain a direct and serious injury that will incapacitate the personnel and require the personnel to be removed from the battlefield.

U.S. Pat. No. 6,014,932 describes a mine that can be remotely armed after placement. The patent describes a system for remotely arming a landmine via satellite or an airborne vehicle, and a corresponding method. This added expense for communication, command and control will significantly increase the cost of the munitions. The hazards associated with the present invention are minimal, and significant injury can be avoided during transport, placement and recovery with minimal training and adherence to procedure.

The need for an effective and safe anti-personnel landmine is exemplified by the proliferation of attempts to produce such ordnance. Under the present invention, a simpler, more efficient, reliable, and less costly method of achieving this end is disclosed.

DESCRIPTION OF THE DRAWINGS

The invention will now be described by way of example only, with reference to the accompanying drawings in which:

FIG. 14 shows various spike penetrator arrangements.

DETAILED DESCRIPTION OF THE PREFERRED EMBODIMENTS

Figure 1:
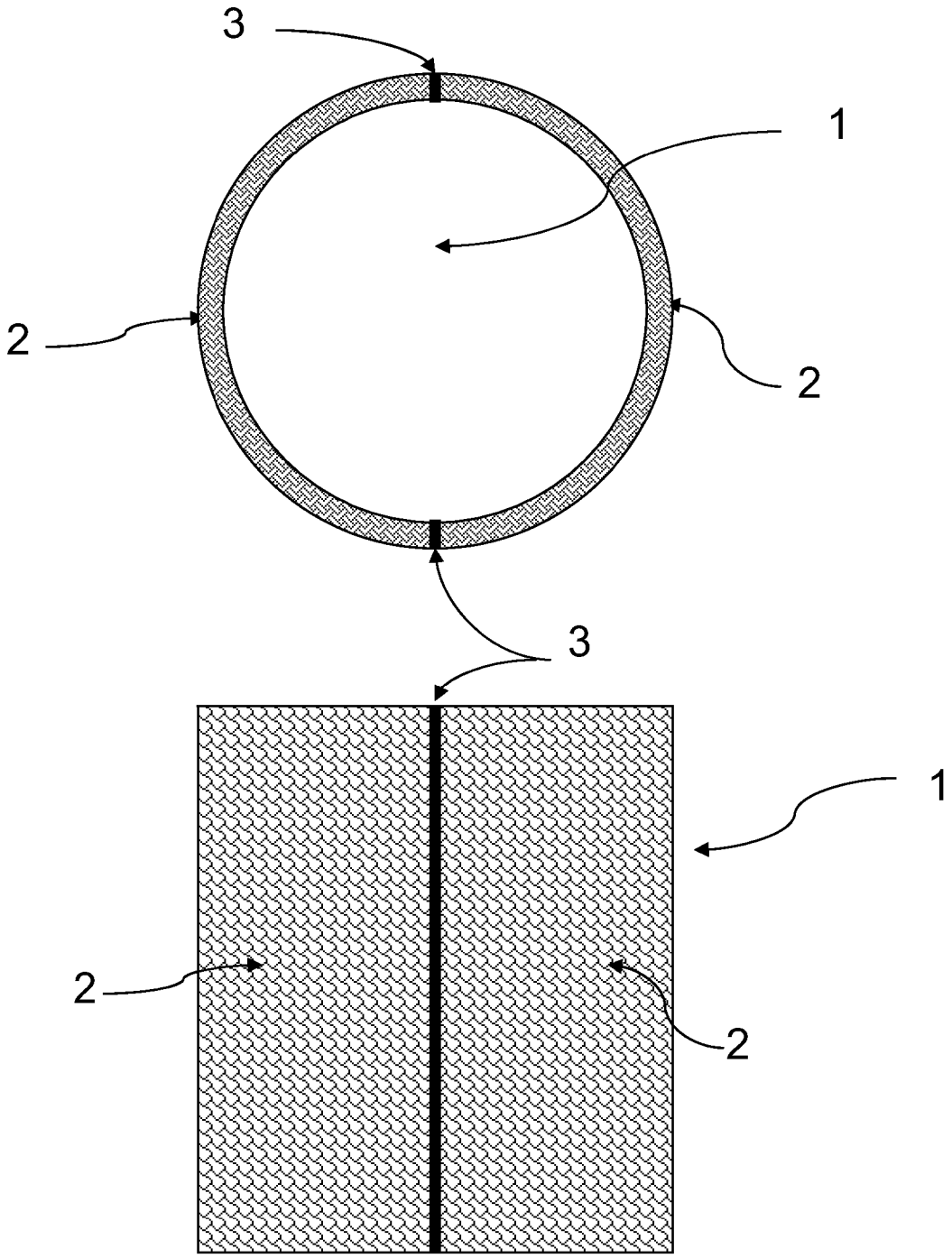
FIG. 1 is a cross-sectional view of a segmented cylinder 1, open at both ends.

FIG. 1 is a cross-sectional view of a segmented cylinder 1, open at both ends. The two halves 2, are segmented at junction points 3.

Figure 2:
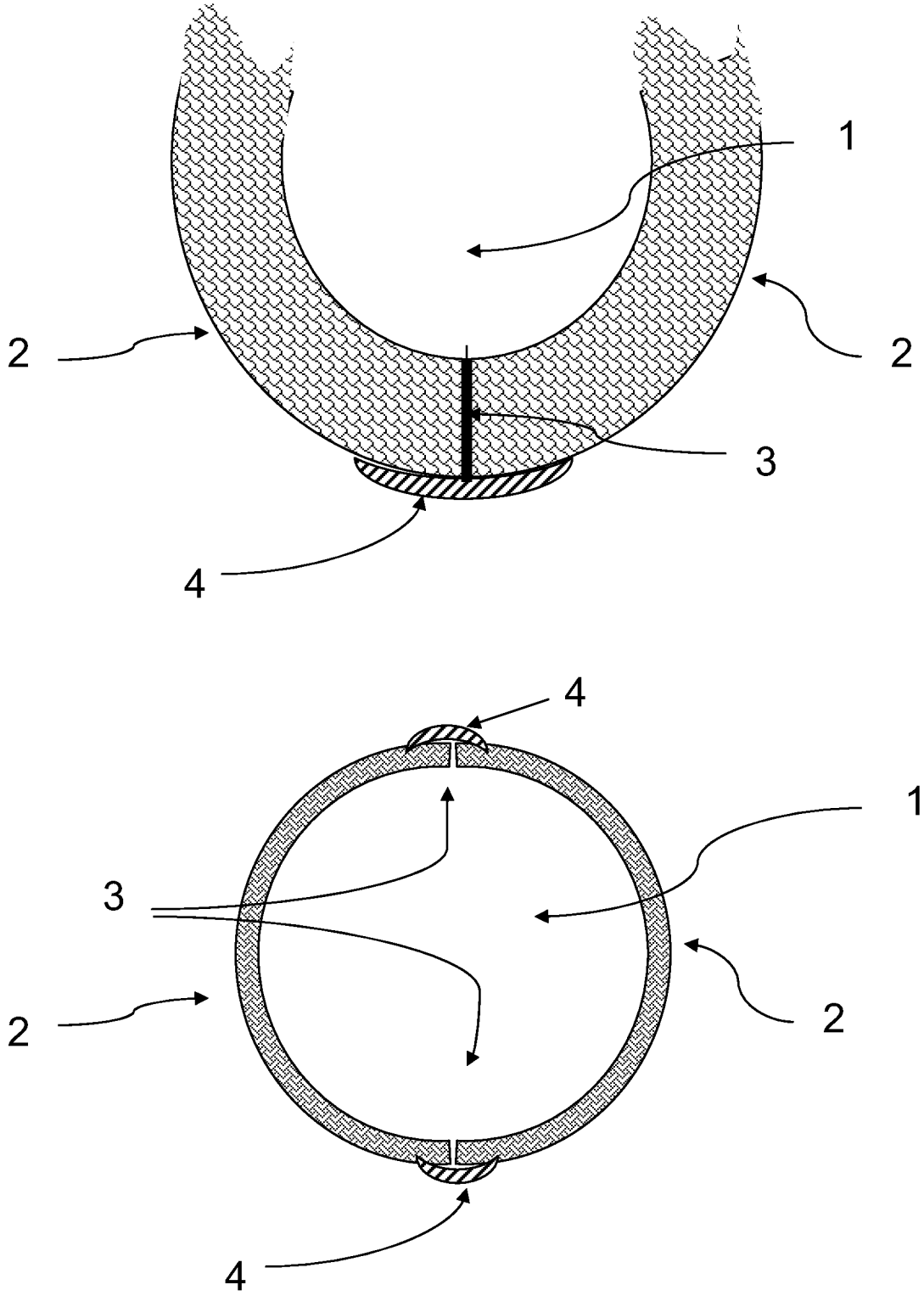
FIG. 2 is a top down view of cylinder 1.

FIG. 2 is a top down view of cylinder 1. Cylinder 1 is shown with two partial halves to better show junction point 3 and structural reactive material 4. The two halves 2 are shown joined at junction points 3 by structural reactive material 4. Structural reactive material 4 can be a reactive metal, plastic, polymer, thermally reactive material, or any reactive material that will secure cylinder 1 halves 2 securely and then release the halves 2 by becoming nonstructural at a predetermined interval after exposure to the environment.

Figure 3:
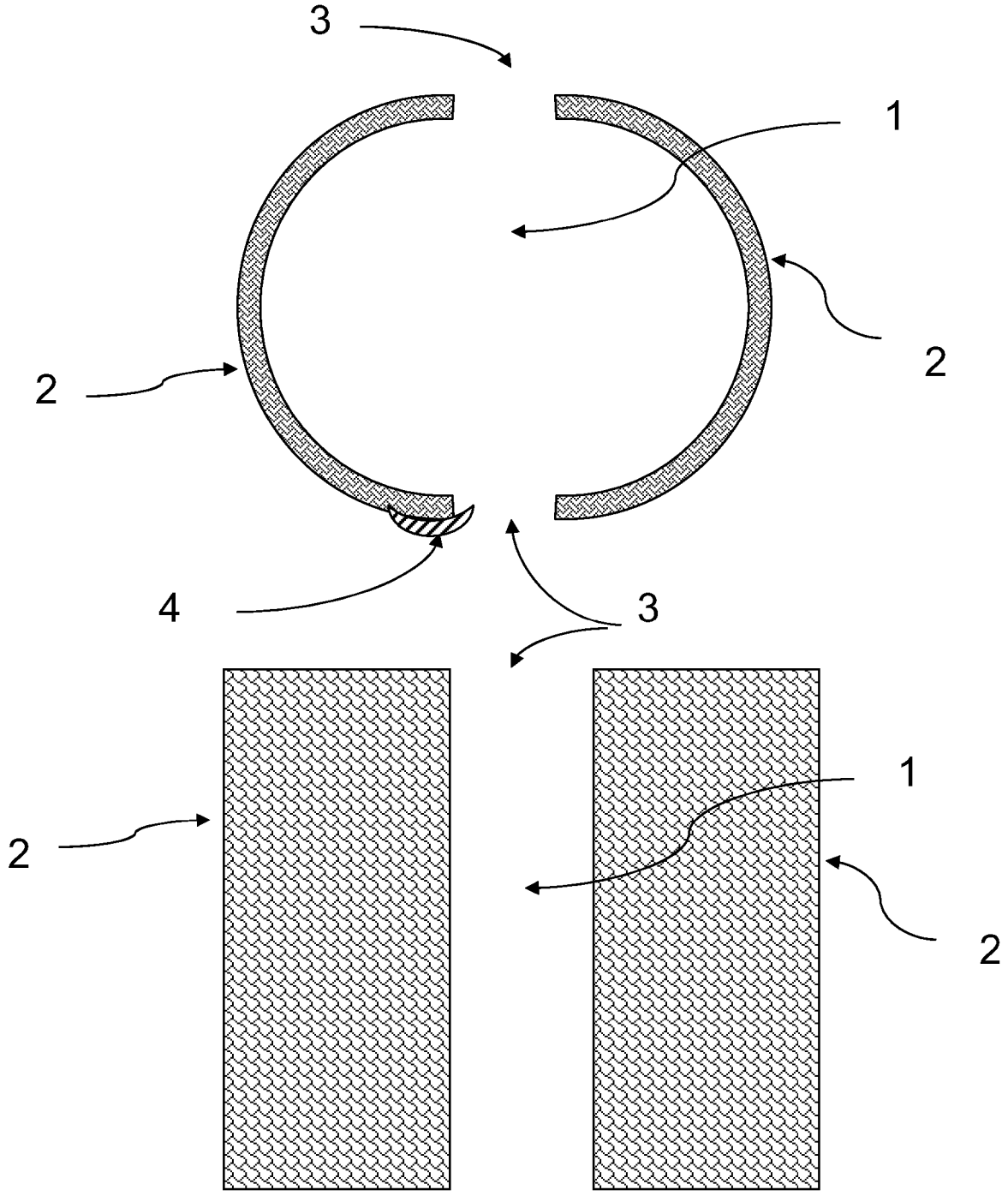
FIG. 3 demonstrates the separation of cylinder 1 into its two component halves 2.

FIG. 3 demonstrates the separation of cylinder 1 into its two component halves 2, separating at the junction points 3 when the structural reactive material 4 has reacted and become nonstructural.

Figure 4:
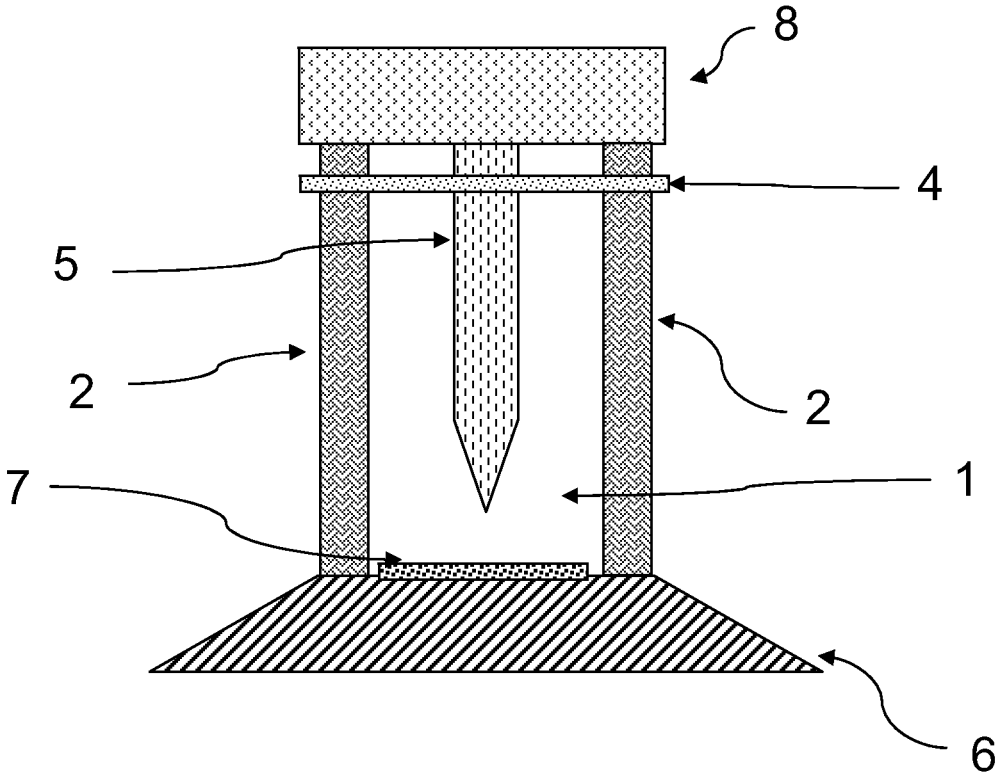
FIG. 4 shows a stereotypical munition detonator arrangement in cross section.

FIG. 4 shows a stereotypical firing pin and detonator arrangement in cross section. Cylinder halves 2 are still joined by structural reactive material 4. Firing pin 5 attached to pressure plate 8 is restricted by cylinder 1 from reaching detonating device 7 attached to main charge 6.

Figure 5:
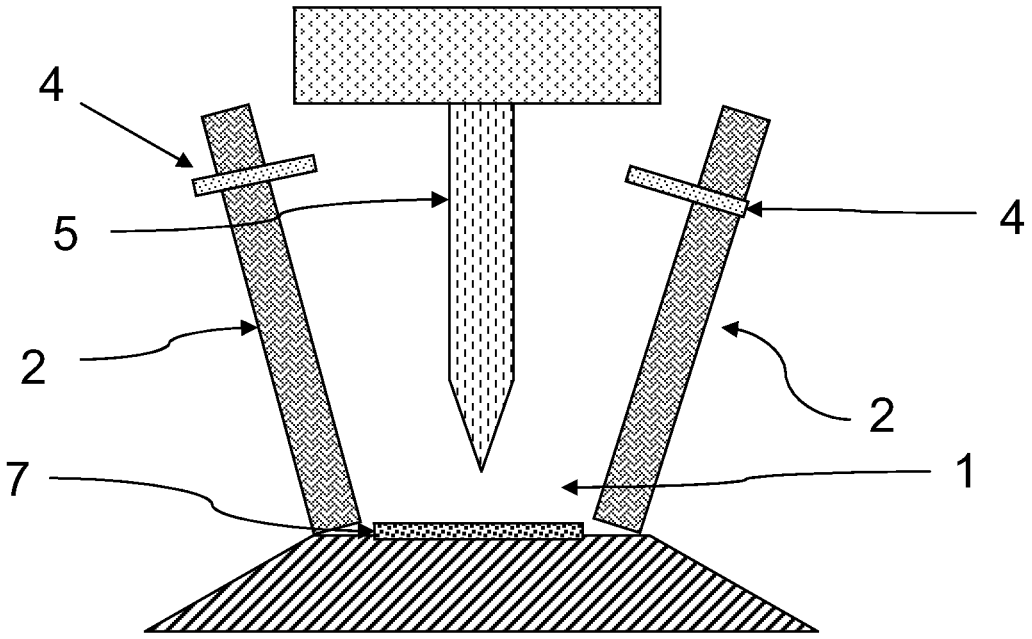
FIG. 5 exhibits cylinder halves 2 falling away after the structural reactive material has reacted and become nonstructural. The munition is now in the armed state.

FIG. 5 exhibits cylinder halves 2 falling away after the structural reactive material 4 has reacted and become nonstructural. The cylinder 1 is no longer blocking the movement of firing pin 5. Firing pin 5 can now operate when activated and impact detonating device 7, exploding the munition. The munition is now in the armed state.

Figure 6:
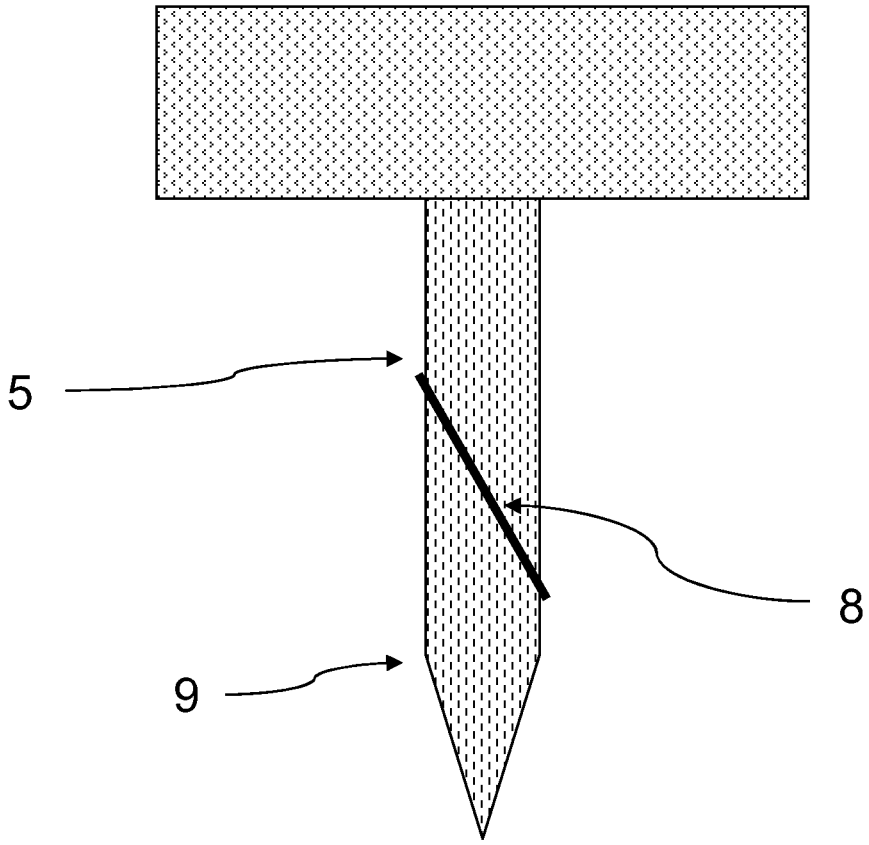
FIG. 6 shows firing pin 5 in cross section.

FIG. 6 shows firing pin 5 in cross section, with structural reactive material 8 bonding the firing pin 5 and its associated tip 9 together. As long as this bond is in place the firing pin 5 can operate when activated.

Figure 7:
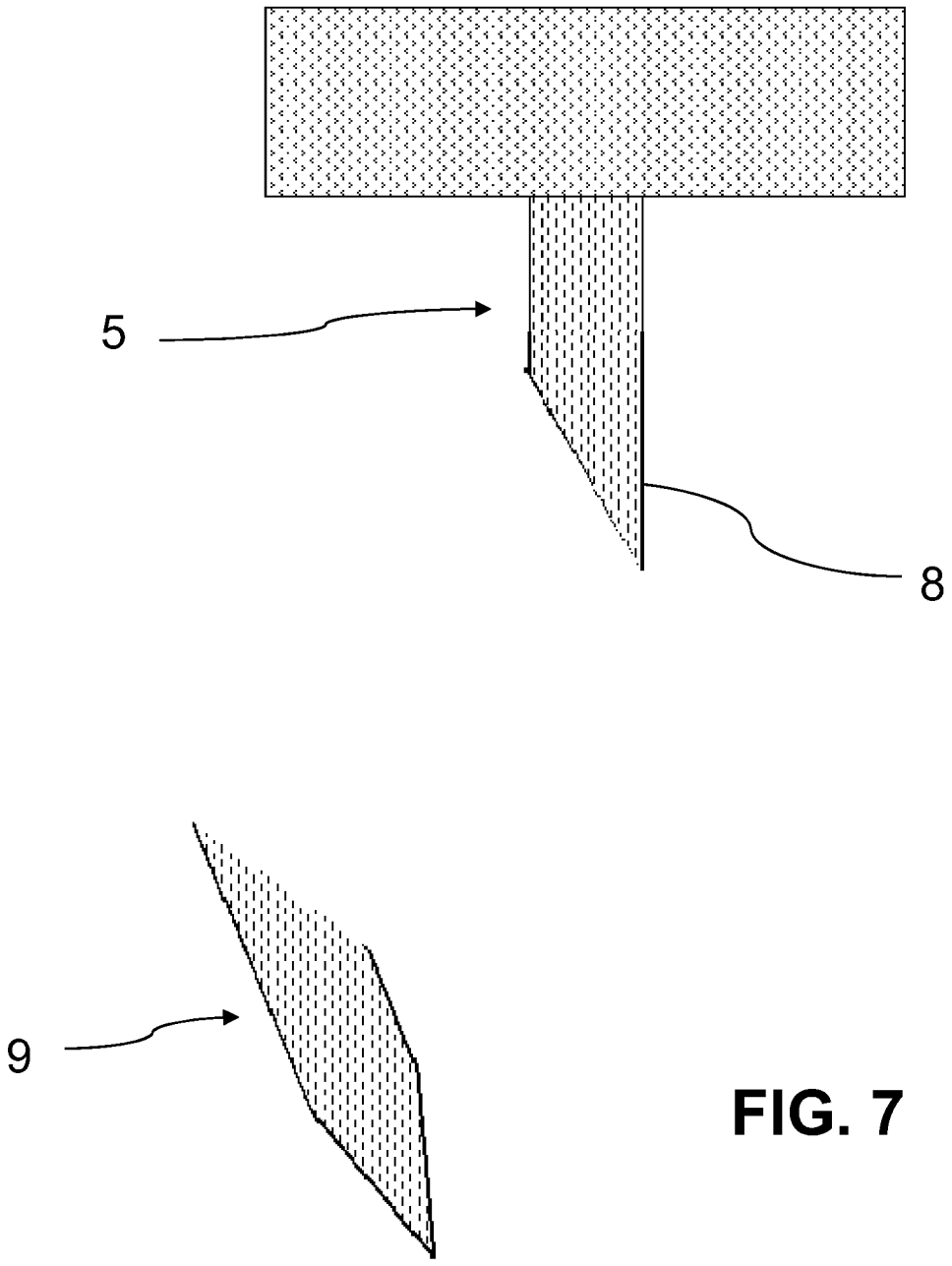
FIG. 7 shows firing pin 5 deactivated. The munition is now in the disarmed state.

FIG. 7 shows firing pin 5 deactivated and the munition put into a safe or unarmed mode by the action of structural reactive material 8 reacting to a nonstructural condition and no longer holding the tip 9 and firing pin 5 together. The munition is now in the disarmed state.

Figure 8:
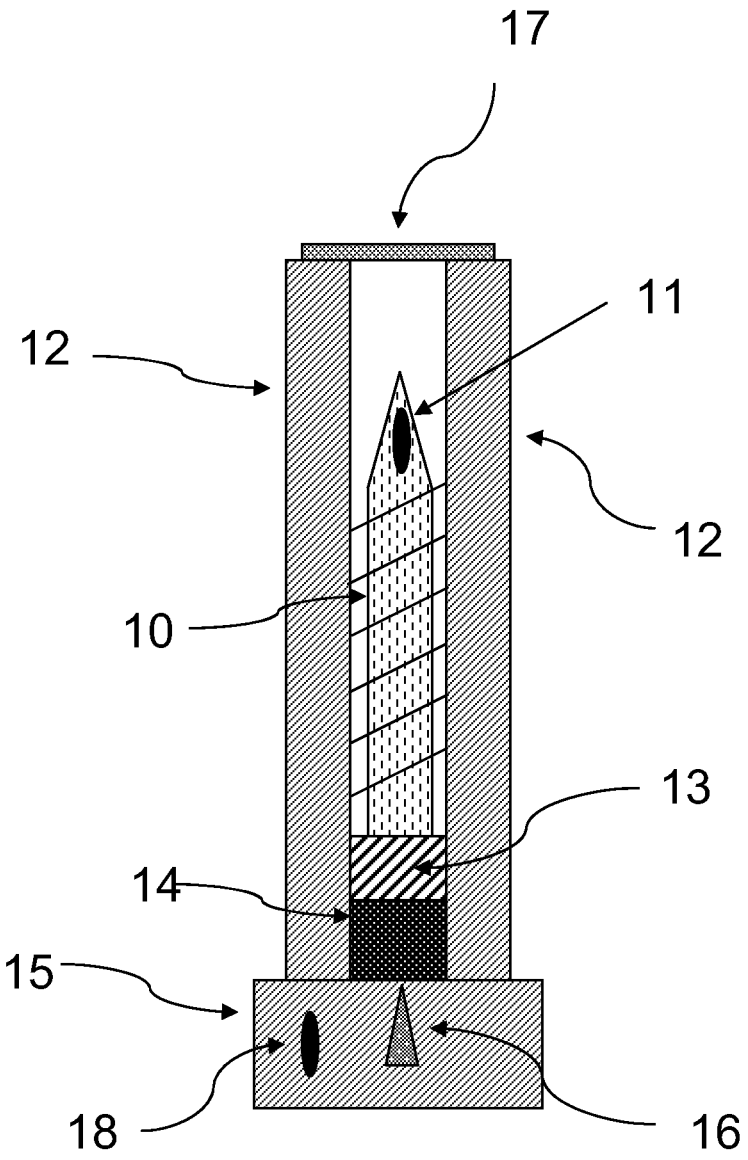
FIG. 8 is a cross-sectional view of a lance mine of the present invention with a spike penetrator shown.

FIG. 8 is a cross-sectional view of a lance mine of the present invention with a spike penetrator 10 with integrated RFID payload 11 shown. The lance mine is comprised of base 15 containing detonator 16 and RFID Chip 18. RFID Chip 18 may be any type of mechanism or circuit suitable for locating the lance mine by electromagnetic means, including passive elements such as a magnet. The tube 12 contains the penetrator 10, the wadding and spin mechanism 13, a cap 17 that seals tube 12 against the elements and the propellant 14. The propellant 14 contains a primer suitable for initiation by detonator 16. Base 15 provides a spring action such that when tube 12 is pressed, such as by an enemy personnel stepping on the lance mine, that tube 12 is compressed into base 15, bringing detonator 16 and propellant 14 together initiating the lance mine. Detonator 16 may also be initiated by shock, pressure or vibration. As propellant 14 expands, wadding and spin mechanism 13 and penetrator 10 are propelled out of tube 12. Wadding and spin mechanism 13 may cause penetrator 10 to spin by interaction of wadding and spin mechanism 13 with tube 12. Cap 17 is blown away or punched through and penetrator 10 is extended away from tube 12. Penetrator 10 may be completely expelled from tube 12; may be completely expelled from tube 12 but be retained by a in place using chain, wire, rope, fiber, cable or other connecting medium to connect the spike penetrator to the buried lance mine; or may extend out of tube two but remain connected to tube 12 by the action of wadding and spin mechanism 13. The preferred operation of penetrator 10 is to pierce through the shoe and penetrate into the foot of an enemy personnel thereby causing incapacitation. It is further preferred that penetrator 10 be configured to resist removal after implantation.

It is a preferred embodiment that spike penetrator 10 be sized between 0.001 mm to 50.0 centimeters in diameter, and from 0.01 millimeters to 100 centimeters in length, and any combination thereof.

The lance mine and spike penetrator 10 may be comprised of various materials and combinations of materials including plastic, metal, non-metal, wood, paper, fiber, pulp, granules, glass, stone, ceramic, chemical, chemicals, chemical agent, combination of chemical agents, or any material with properties sufficient to accomplish the penetration function. Making the penetrator 10 of a porous material such as wood is highly desirable due to cost and suitability of the material to deliver chemistry to the enemy personnel.

Figure 9:
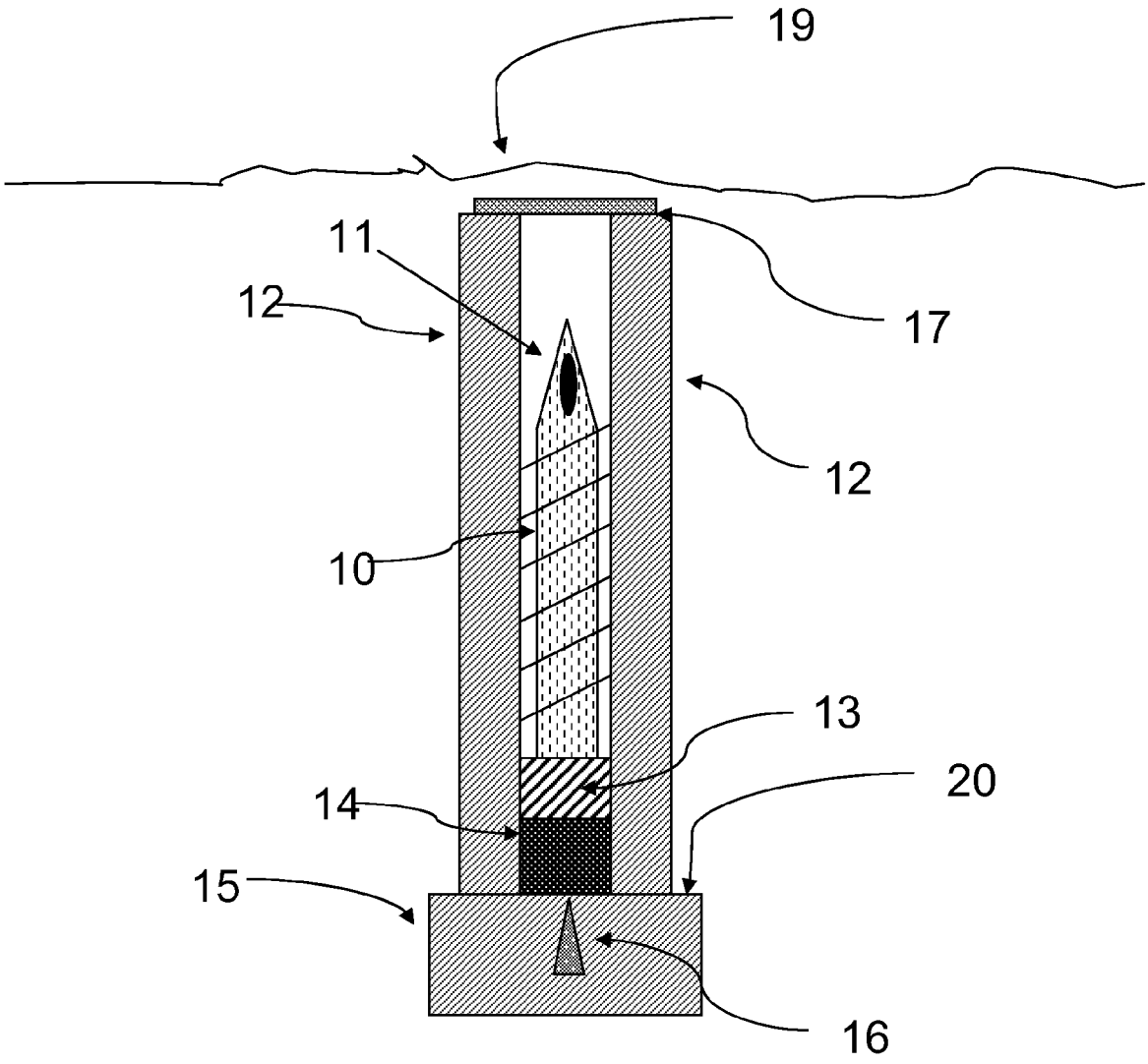
FIG. 9 is a cross-sectional view of a lance mine of the present invention with a spike penetrator shown after placement.

FIG. 9 is a cross-sectional view of a lance mine of the present invention with a spike penetrator 10 shown after placement in the ground surface 19. Base 15 provides a stable and resistive footing such that when tube 12 is pressed into the earth by the footfall of an enemy personnel, that the detonator 16 can initiate propellant 14 driving penetrator 10 into the foot of the enemy personnel. Cap 17 prevents the entry of foreign material and seals tube 12 against the elements. Cap 17 is easily pierced by penetrator 10. When an enemy personnel steps on the lance mine, pressure is applied against tube 12 that presses against base 15 initiating detonator 16. Detonator 16 explodes propellant 14 providing gas pressure against wadding and spin mechanism 13 and propelling penetrator 10 through cap 17 and into the enemy personnel's foot. This action may also be provided through non-pyrotechnic means such as compressed gas, mechanical means, a gas spring, or other non-pyrotechnic means as desired The base 15 provides for an area that extends beyond tube 12 providing a lip 20. Lip 20 is provided to facilitate the placement of the lance mine without putting pressure on tube 12.

Figure 10:
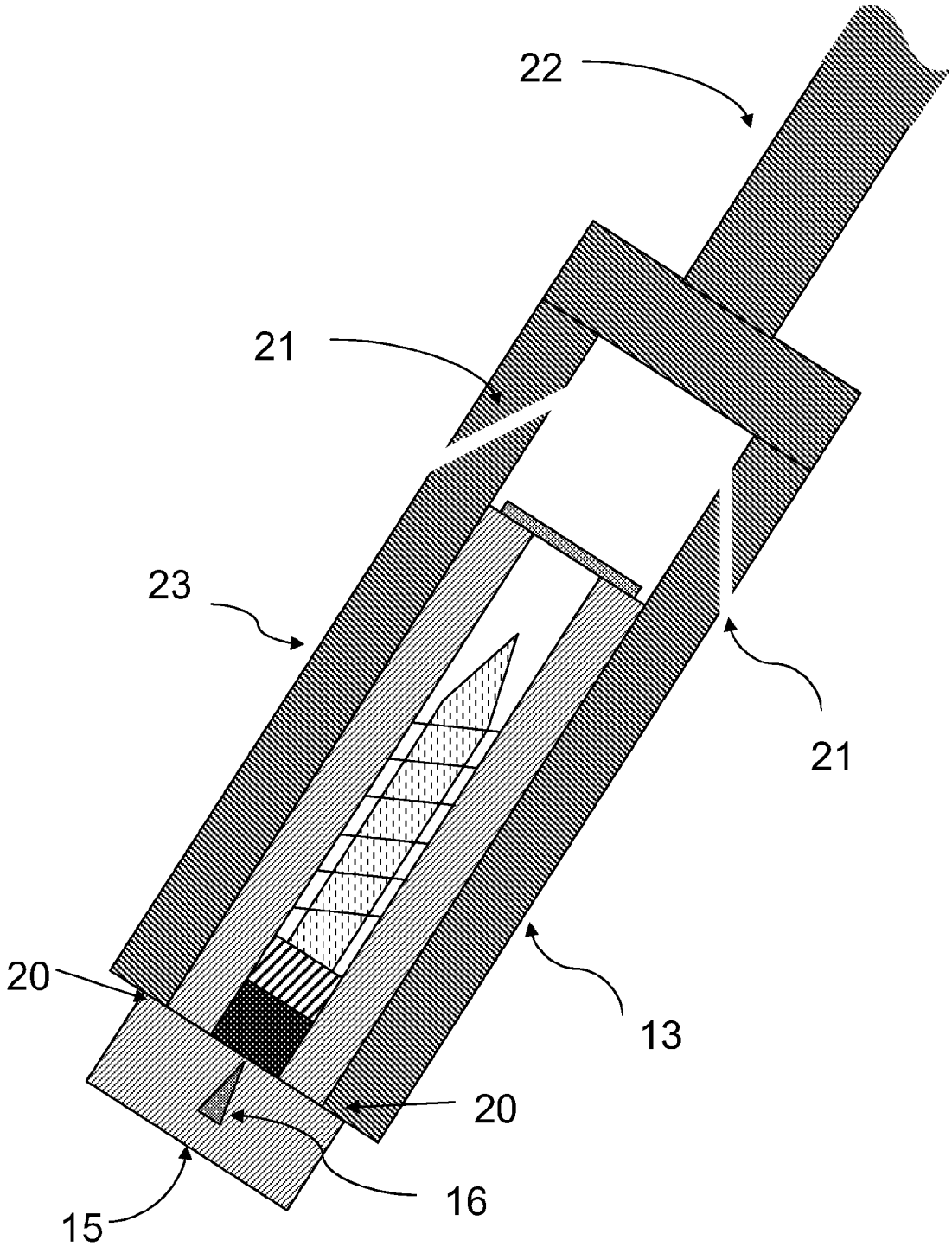
FIG. 10 is a cross-sectional view of a lance mine placed in a ground insertion tool.

FIG. 10 is a cross-sectional view of a lance mine placed in a ground insertion tool. The ground insertion tool is comprised of chamber 23, handle 22 and gas release ports 21. The chamber 23 is fitted to contain the lance mine and engage base 15 at lip 20. In this manner the base 15 can be pressed into the ground without causing any pressure on the lance mine that would cause detonator 16 to operate. Should the lance mine accidently operate after placement in the ground insertion tool, the lance mine action would be contained by the chamber 23 and the resulting gas would be released by gas release ports 21. The lance mine would be forced out of chamber 23 and as it will have already expended itself will poise no significant danger. The failed lance mine can be recovered and disposed of or kept for refurbishment.

Figure 11:
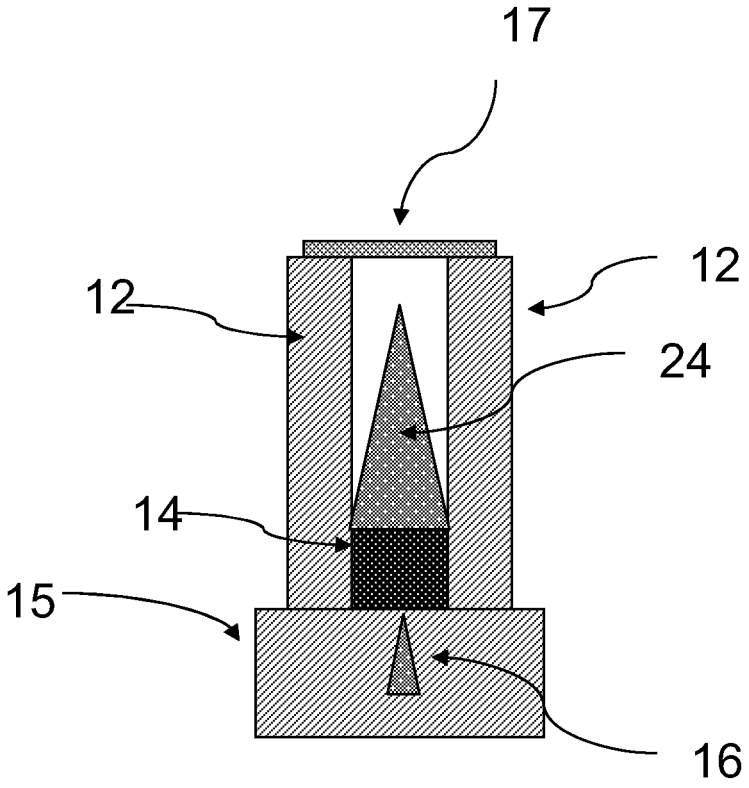
FIG. 11 is a cross-sectional view of a lance mine with a smaller spike penetrator more suited to surface deployment.

FIG. 11 is a cross-sectional view of a lance mine with a shorter spike penetrator 24. This shorter lance mine is more suited to easy concealment and surface deployment. The operation of the lance mine is identical to the operation described in FIGS. 8 and 9. The shorter penetrator 24 facilitates a shorter tube 12 with other lance mine components remaining unchanged. The shorter penetrator 24 serves the same purpose as the penetrator 10 in FIGS. 8 and 9.

Figure 12:
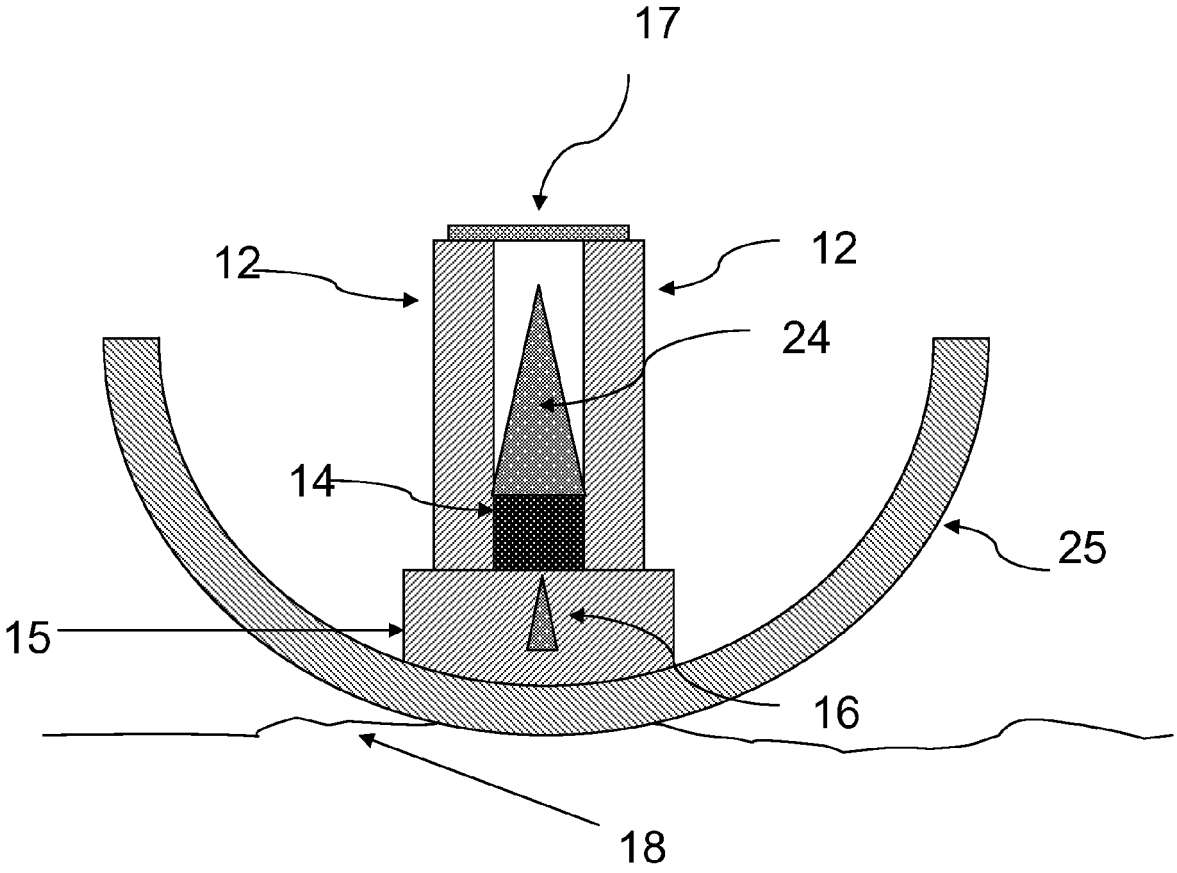
FIG. 12 is a cross-sectional view of a lance mine with a smaller spike penetrator mounted in a self-righting mine enclosure.

FIG. 12 is a cross-sectional view of a lance mine with a shorter spike penetrator 24 mounted in a spherical self-righting mine enclosure 25. It is an embodiment of the present invention that the lance mine can be placed and will maintain itself in the vertical position most suitable for proper initiation when stepped upon by enemy personnel. Self righting mine enclosure 25 rests on top of ground surface 18, the spherical curved exterior of enclosure 25 allowing a rolling motion to occur due to any displacement in the center of gravity of the lance mine and bringing tube 12 into a vertical or near vertical position.

Figure 13:
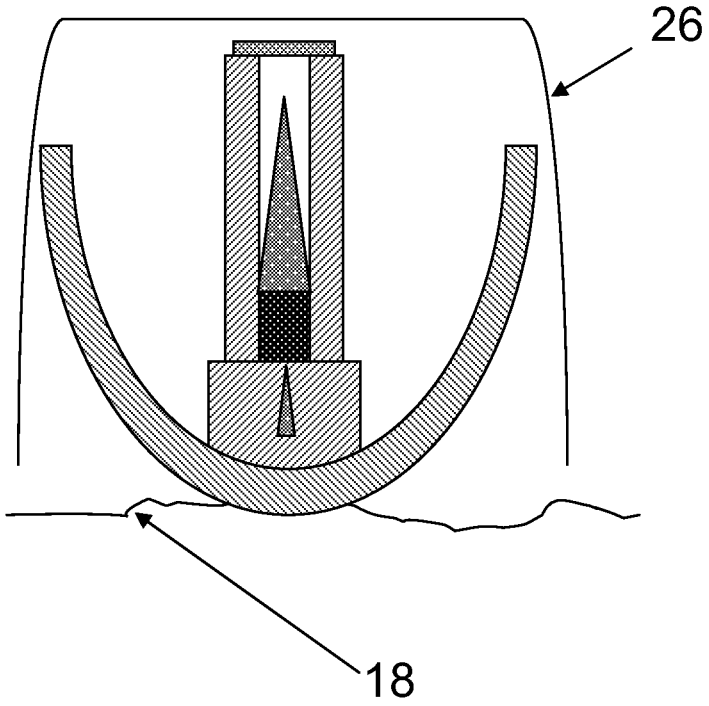
FIG. 13 is a cross-sectional view of a lance mine with a smaller spike penetrator mounted in a self-righting mine enclosure under a self-camouflaging enclosure.

FIG. 13 is a cross-sectional view of a lance mine with a smaller spike penetrator mounted in a self-righting mine enclosure under a camouflaging enclosure 26. Camouflage enclosure 26 may appear as any component of the naturally occurring ground such as a stone, leaf, twig, a reflective surface to mask a lance mine placed just under the water, soil, sand, or any other surface characteristic desirable for the operation of concealing or the lance mine. The camouflage enclosure 26 may be brightly colored or otherwise made easily identifiable for practice, training or other circumstances as required. It is an embodiment that camouflage enclosure 26 be made self-camouflaging by coating with a sticky substance such as an adhesive. In this manner the ground material such as sand, soil, grass or leaves may be blown or otherwise be brought or come in contact with the adhesive and stick to the camouflage enclosure 26, effectively camouflaging the camouflage enclosure 26, and in this manner the lance mine can be readily camouflaged in any environment. Adhesives of any type may be used including pressure-sensitive adhesives such as acrylate copolymers and contact cements. Water and sun resistant adhesives are preferred.

FIG. 14 shows various spike penetrator 10 arrangements. All of these arrangements are suitable for spike penetrator 10 or short spike penetrator 24 and exhibit only a few of the many possible arrangements of the preferred embodiments. FIG. 14A shows a spike penetrator 10 equipped with stops 27 that pivot on hinge 28. Stops 27 are shown in their folded position for storage in tube 12 (See FIG. 8). FIG. 14B shows a spike penetrator 10 with stops 27 rotated about hinge 28 to their open position. This would occur on lance mine initiation and the spike penetrator would fly clear of tube 12, penetrate the shoe and foot of the enemy personnel with considerable force and speed, and the stops 27 would prevent further penetration into the foot by penetrator 10. In this manner, the foot and the shoe would be fastened or nailed together by penetrator 10. FIG. 14B shows penetrator 10 equipped with a detachable RFID chip 30 that will drive into the foot of the enemy personnel, and will detach and stay in the foot even if penetrator 10 is extracted. In this manner, the enemy personnel can be identified at to the particular lance mine encountered, and other information, timing and tracking functions native to the particular RFID used. Optional reactants 29 are shown attached to penetrator 10 in notches, but may also be facilitated as a coating, inserted in holes or secured or fastened to penetrator 10 in any similar fashion. Optional reactants 29 may be drugs such as sedatives, pain inducers such as pepper powder, or glues to firmly secure the penetrator 10, or a combination as per the mission requirement. FIG. 14C shows penetrator 10 equipped with a sharp piercing point 31 and a screw surface 32 to resist easy removal by enemy personnel. Fixed stop 33 allows penetrator 10 to be fired into the enemy personnel's shoe and foot with considerable force while assuring the penetrator will be stopped by the shoe and remain implanted into the foot. For all purposes herein the term shoe references any foot covering including boots, sandals, and protective footwear or similar. Fixed stop 33 may also serve as wadding or spin device 13 when desired, said induced spin of penetrator 10 providing benefit in the penetration of defensive padding or foot armor and assisting with the assured implantation of penetrator 1 and the dispersement of any optional payload 26. Fixed stop 33 may also prevent spike penetrator 10 from fully escaping tube 12, and in this manner assure the lance mine and spike penetrator 10 remain joined after lance mine initiation. FIG. 14D shows penetrator 10 with an optional point 34 for cutting and optional point 34 is shaped to prevent extraction of the penetrator 10, and a flexible attachment 35 for attachment of penetrator 10 to the lance mine after initiation. Flexible attachment 35 may be a simple chain or attaching wire, or may be a conductive element for the conduction of electrical current, or may be a tube for the administration of a fluid or gas to penetrator 10 after it has penetrated the foot of the enemy personnel. Flexible attachment 35 may also bear printed instructions to the now wounded enemy personnel advising them of how and where to surrender in order to receive prompt medical attention. These printed instructions may also advise the enemy personnel of the chemicals, drugs or biologicals they have just been injected with and explain how critical it is to receive the prompt medical attention to avoid extensive injury or death.

Figure 15:
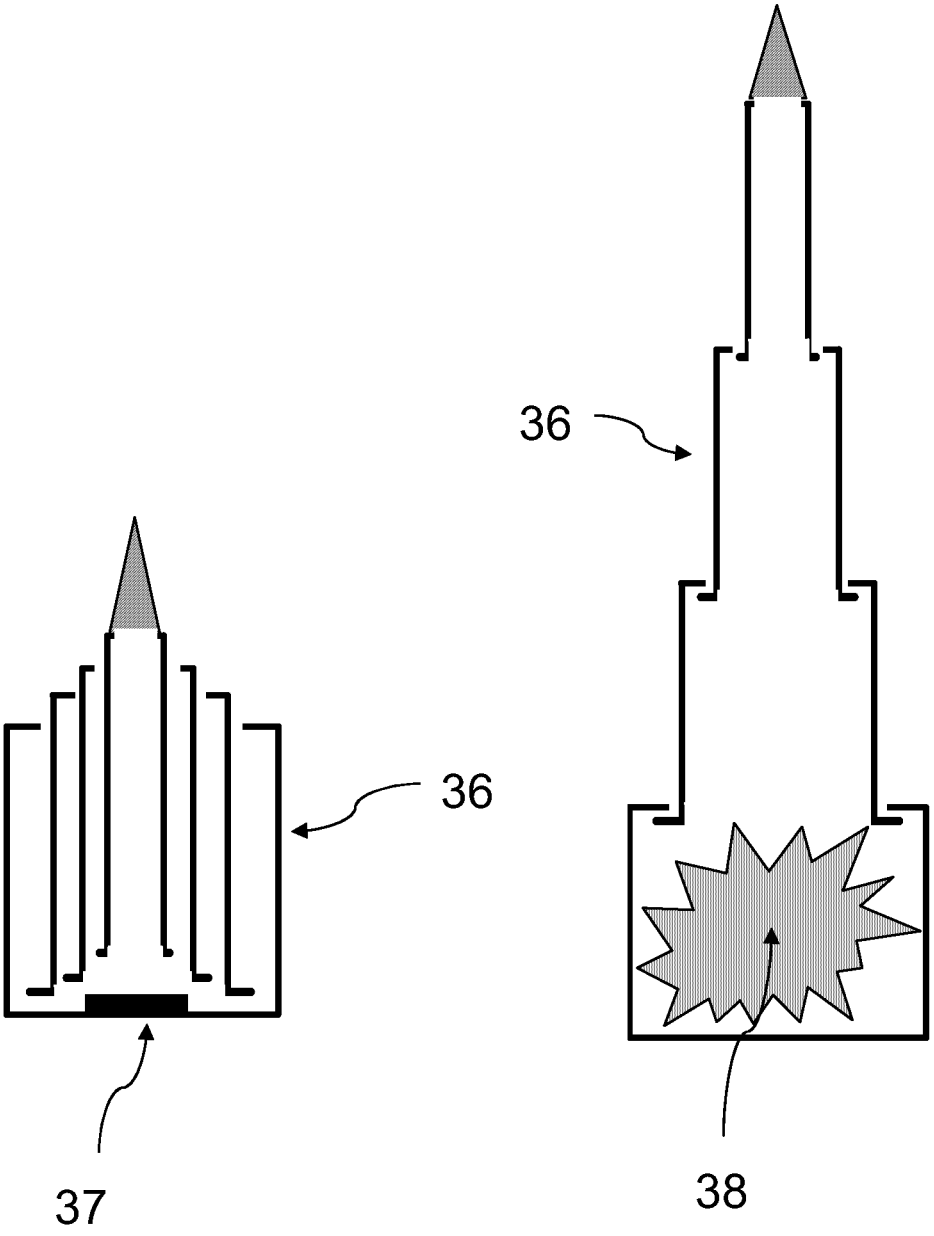
FIG. 15 shows an expanding or telescoping spike penetrator powered by a pyrotechnic charge.

FIG. 15 shows an expanding or telescoping penetrator 36 powered by a pyrotechnic charge 37. In this manner the telescoping penetrator 36 may fully benefit from the expanding gas 38 generated thereby extending penetration power into the enemy personnel. Further, the telescoping penetrator 36 may optionally remain attached to the lance mine. The telescoping feature assures penetrating power will be applied through the full extension of telescoping penetrator 36.

Figure 16:
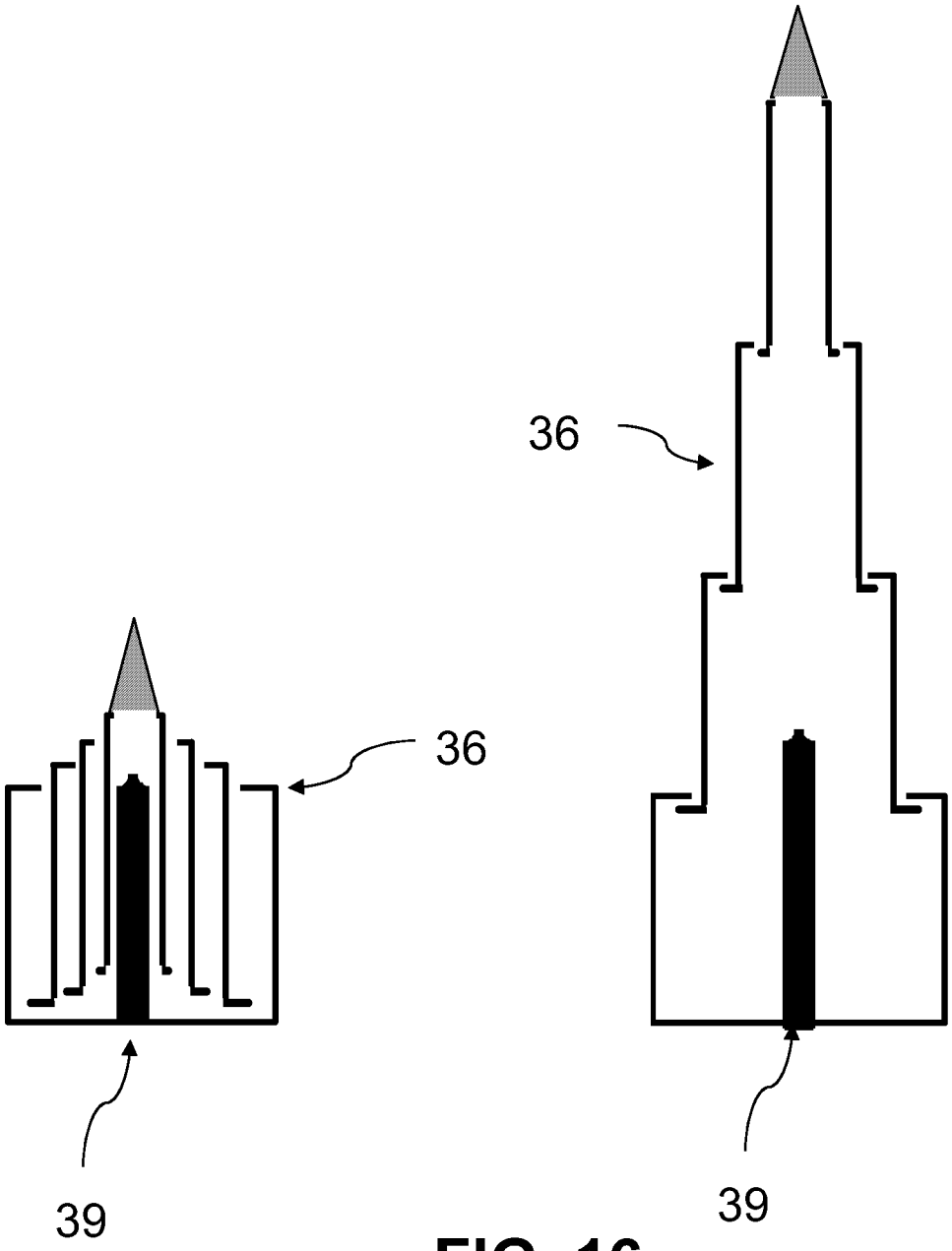
FIG. 16 shows an expanding or telescoping spike penetrator powered by compressed gas.

FIG. 16 shows an expanding or telescoping penetrator 36 powered by non-pyrotechnic means 39. Non-pyrotechnic means 39 may be compressed gas, a mechanical spring, a gas spring, or other non-pyrotechnic means as desired.

Figure 17:
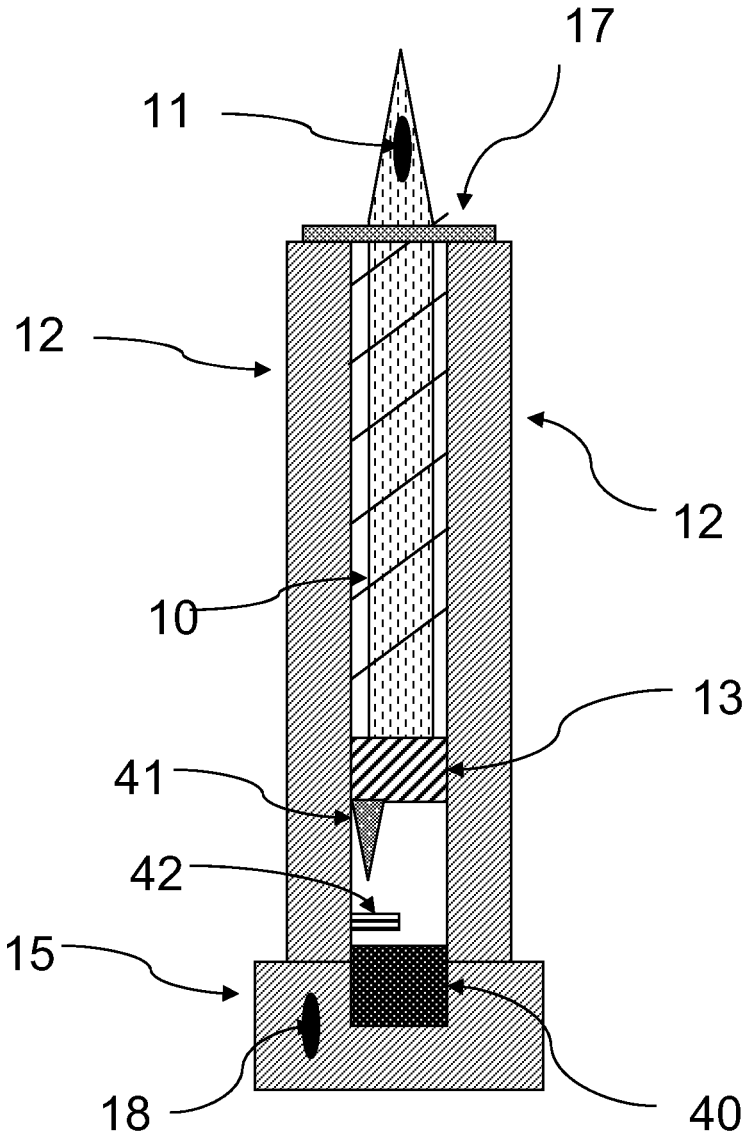
FIG. 17 shows a lance mine with an exposed spike penetrator and manual means for arming and safing the lance mine

FIG. 17 is a cross-sectional view of a lance mine of the present invention with a spike penetrator 10 with integrated RFID payload 11 shown. The lance mine is comprised of base 15 containing propellant and initiator mix 40 and RFID Chip 18. RFID Chip 18 may be any type of mechanism or circuit suitable for locating the lance mine by electromagnetic means, including passive elements such as a magnet. The tube 12 contains the spike penetrator 10, the wadding and spin mechanism 13, a cap 17 that seals tube 12 against the elements and a firing pin 41. The propellant 40 contains a primer suitable for initiation by firing pin 41. When the protruding head of spike penetrator 10 is depressed by an insurgent stepping on the lance mine, the firing pin 41 moves into propellant 40 initiating propellant 40 and propelling spike penetrator 10 into the insurgents foot. The firing pin 41 is offset mounted such that spike penetrator 10 can be rotated to allow firing pin 41 to come into contact with propellant 40, or be blocked by safety device 42. In this manner, the lance mine can be armed or disarmed manually.

Figures 18, 18A, 18B:
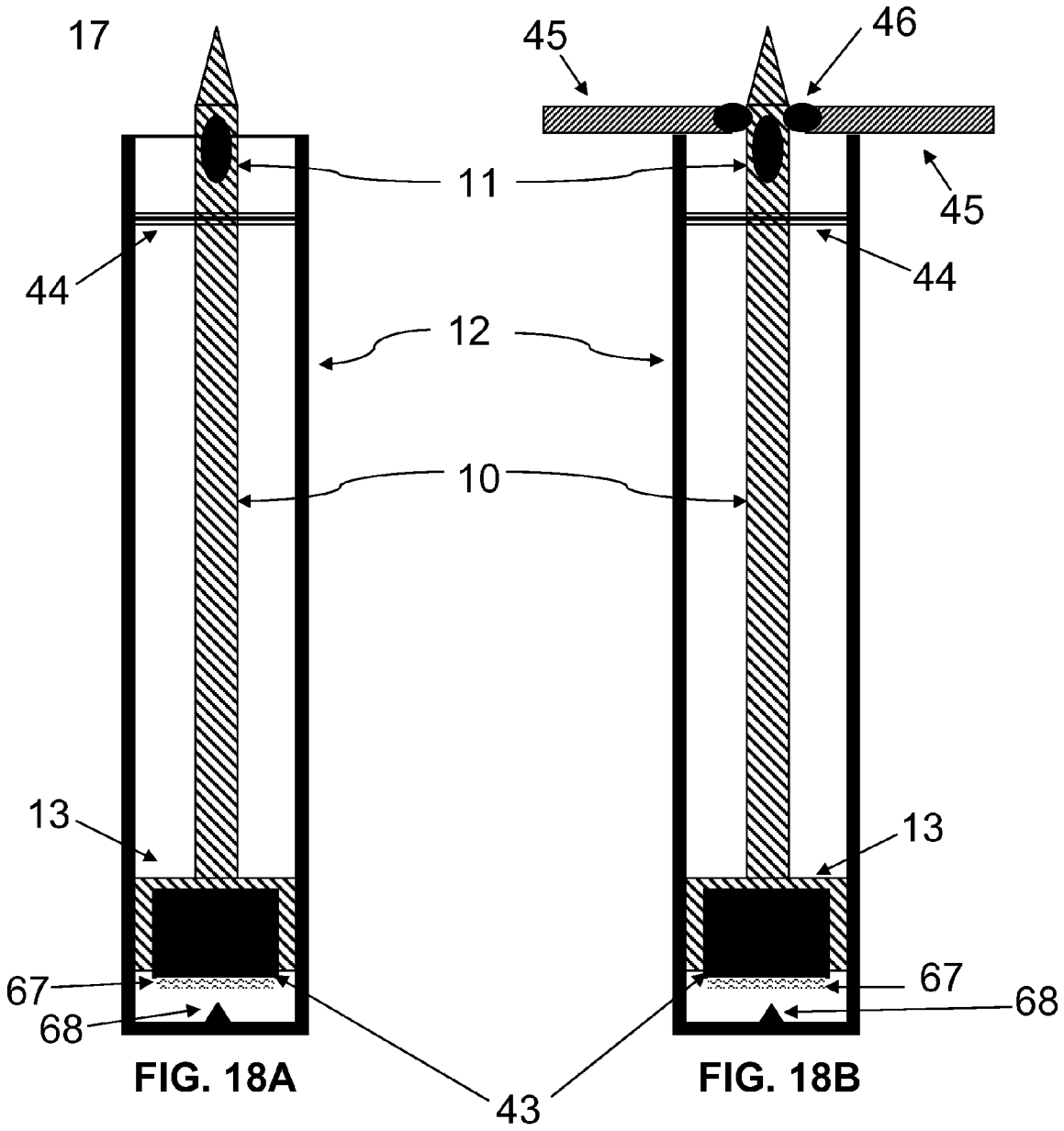
FIG. 18 shows a lance mine with an exposed spike penetrator with integrated propellant and initiator with optional lance mine tube seal or pickup washer.

FIG. 18 is a cross-sectional view of a lance mine of the present invention with a spike penetrator 10 with integrated RFID payload 11 shown. It is an embodiment of the present invention that spike penetrator 10 contain an integrated propellant and initiator chamber and propellant and initiator 43. It is an embodiment of the present invention that the propellant chamber 43 be of a diameter to fit tube 12, and that the spike penetrator be the same diameter as the propellant chamber or smaller. The spike penetrator 10 may be any shape, including round or square. When the propellant chamber 43 is larger in diameter than the spike penetrator 10, then upon firing, the propellant force on the surface impacting area of the spike penetrator 10 is a multiple of the ratio of the area of the propellant chamber 43 divided by the impacting area of the spike penetrator 10. When spike penetrator 10 is stepped on and moves to the bottom of tube 12, the propellant 43 fires and drives spike initiator 10 out of tube 12. It is an embodiment of the present invention that retaining pin 44 hold spike penetrator 10 in place in tube 12. It is a further embodiment of the present invention that retaining pin 44 be selected to release spike penetrator 10 after a predetermined level or force has been applied to the head of spike penetrator 10. By selecting retaining pin 44 to release spike penetrator 10 at a given load, the lance mine can be selected to fire only against a target that exerts a sufficient load on the lance mine. It is an embodiment of the present invention that the lance mine is selectable to fire only when the force is sufficient to indicate, for example, an adult male insurgent and not fire when stepped on by a 10 year old child of average weight. FIG. 18B shows the tube 12 containing the spike penetrator 10, and sealed against the elements by pickup washer 45. Pickup washer 45 seals tube 12, and seals against spike penetrator 10 with washer seal 46 closing tube 10 against the elements. Pickup washer 45 provides surface area to stabilize and hold tube 12 in place in loose soils including sand and watery soil.

Figure 19:
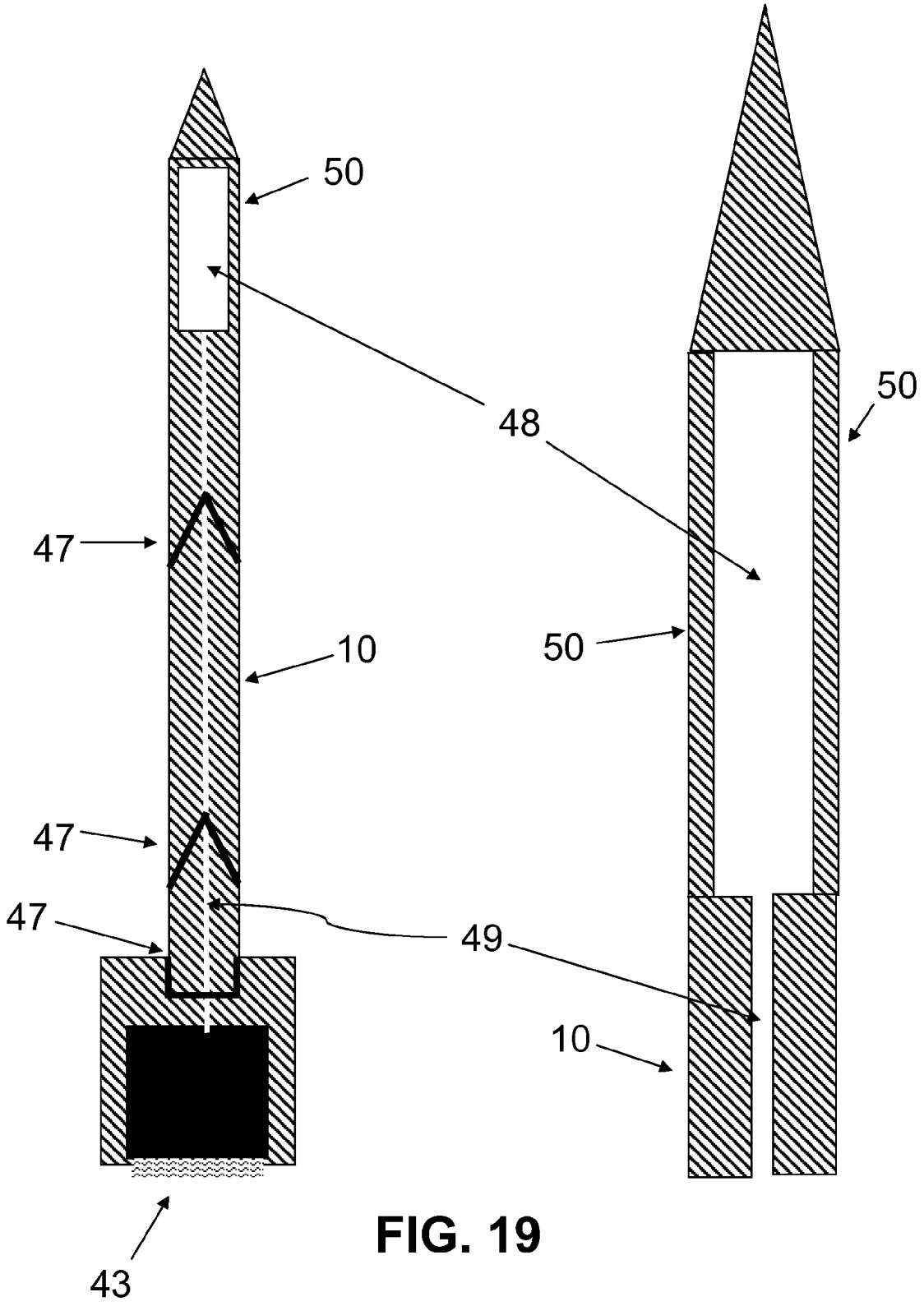
FIG. 19 is a cross-section of a spike penetrator with integrated propellant and propellant connected payload means.

FIG. 19 exhibits the spike penetrator 10 with integrated propellant and initiator chamber and propellant 43. It is an embodiment of the present invention that the spike penetrator 10 be self propelled and contains all active pyrotechnic components of the lance mine. Spike penetrator 10 has mechanical joints 47 such that spike penetrator 10 will separate if an attempt is made to pull it out leaving a section in the foot that is removable only by surgery. Mechanical joints 47 are preferred to be rigid until they are exposed to blood at which time they soften and become pliable. Payload chamber 48 contains any mission specific materials. Fuse train 49 allows a timed ignition source and/or pressure from the integrated propellant and initiator chamber and propellant 43 to be introduced in payload chamber 48. Payload chamber walls 50 may be porous to gas or liquid, and/or be frangible as desired.

Figure 20:
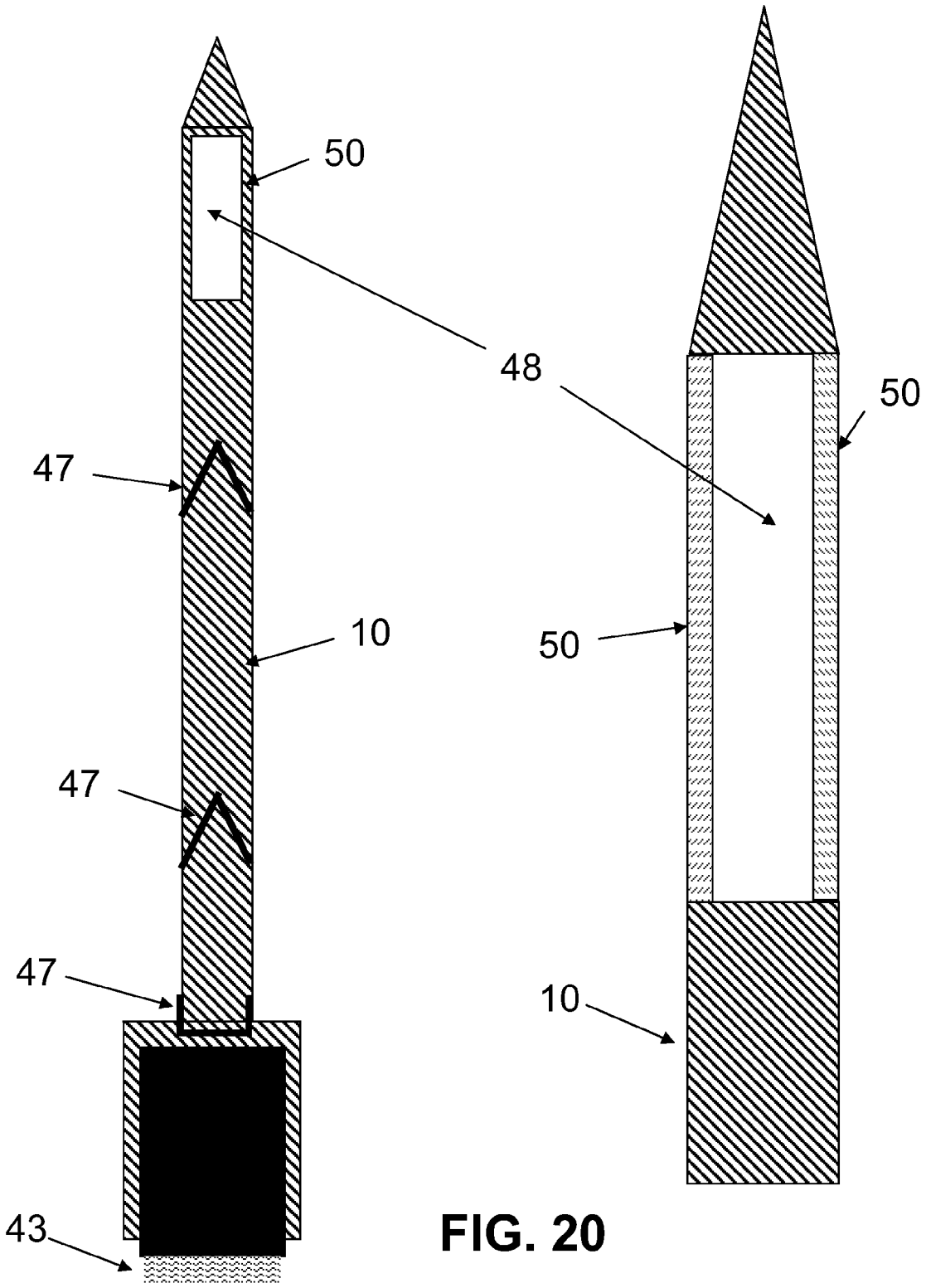
FIG. 20 is a cross-section of a spike penetrator with integrated propellant and payload means.

FIG. 20 exhibits the spike penetrator 10 with integrated propellant and initiator chamber and propellant 43. Integrated propellant and initiator chamber and propellant 43 may be as large as needed to supply sufficient pressure depending on the mission requirements. Payload chamber 48 contains any mission specific materials. Payload chamber walls 50 may be porous to gas or liquid, including blood and other body fluids, and/or be frangible as desired.

Figures 21, 21A, 21B:
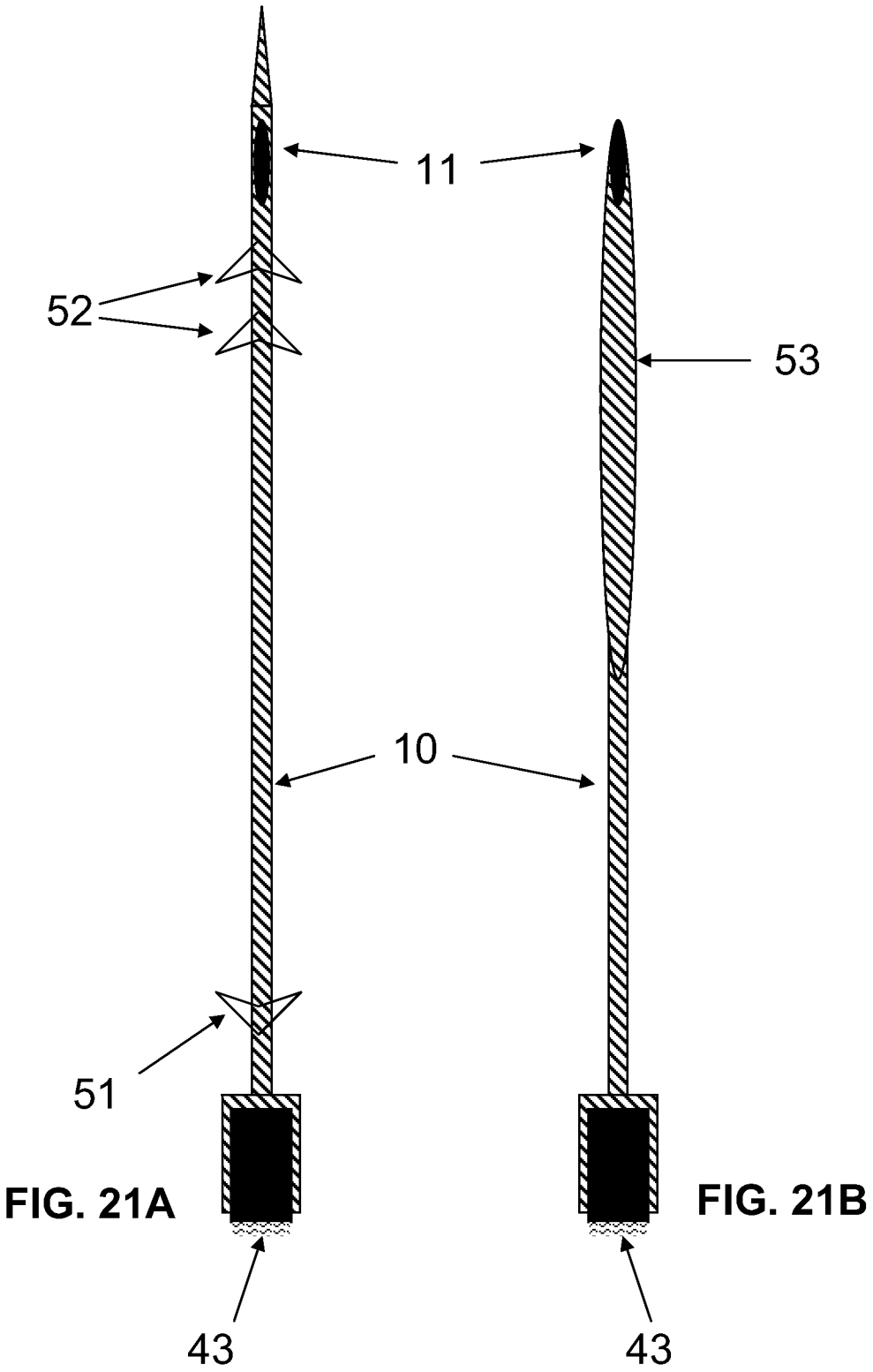
FIG. 21 shows spike penetrators with integrated propellant and payload means for RFID delivery in both expanded and straight spike penetrator profiles.

FIG. 21 shows two spike penetrators 10 with integrated propellant and initiator chamber and propellant 43. Both have an RFID chip 11 integrated as the payload. The profiles are sculpted differently to facilitate different missions. FIG. 21A has straight sides to better penetrate armored boots, landmine resistant footwear, robot skin and the like. It shows ridges to facilitate stopping the spike penetrator in the boot sole 51, and for resisting pullout 52. These ridges may be machined, stamped cast or otherwise shaped, including circular and monolithic. FIG. 21B has an expanded tip 53 to provide for holding power when embedded in the foot. It is an embodiment of the present invention that the shape and surface details of the spike penetrator be selectable to facilitate mission requirements.

Figure 22:
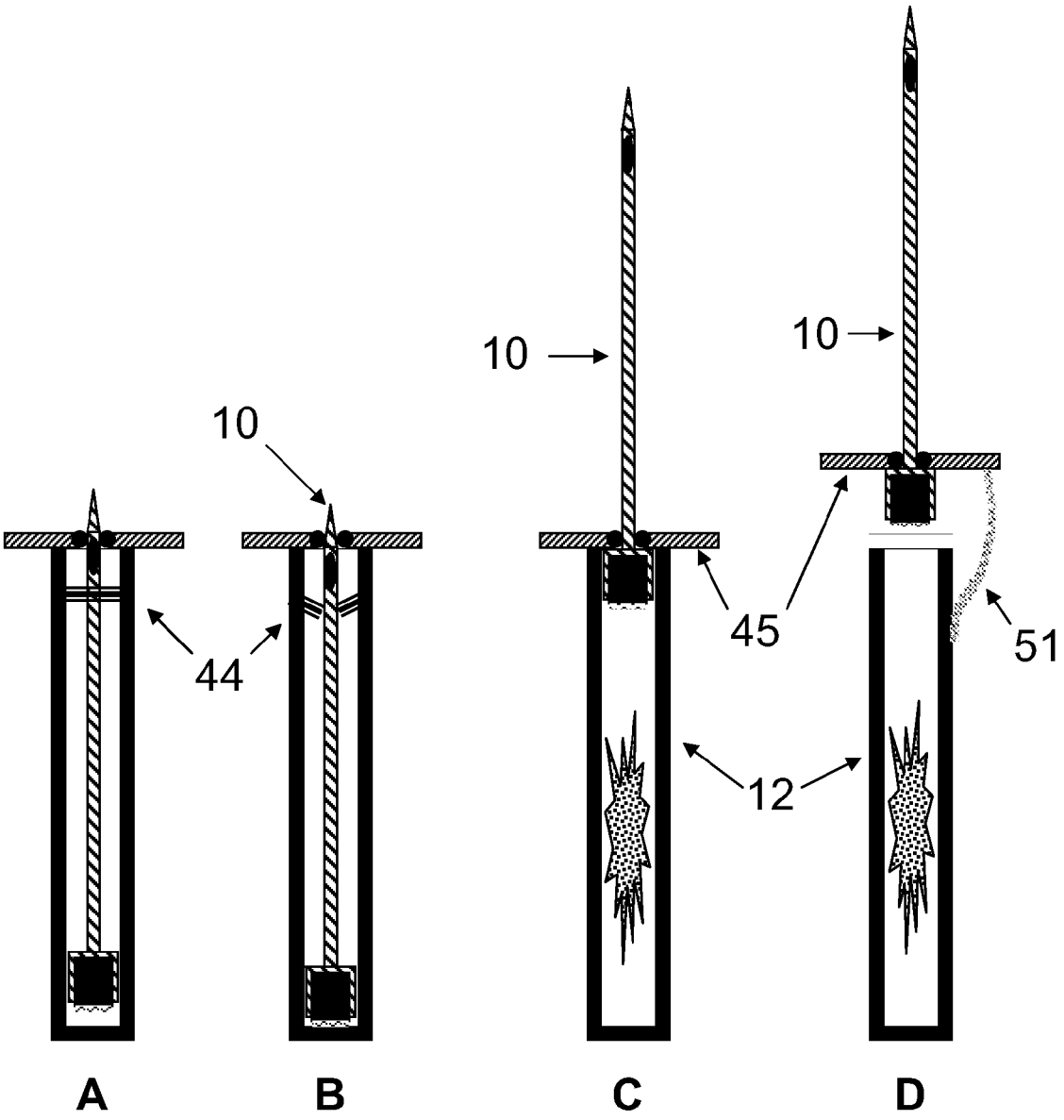
FIG. 22 shows operation of lance mine with integrated spike penetrators including tethering and pickup washer means.

FIG. 22 shows the firing sequence and possibilities for the lance mine. In FIG. A the lance mine is in an armed and stable condition. In FIG. B when pressure is applied by stepping on or otherwise contacting the lance mine, the spike penetrator 10 is forced down and the retaining pin 44 is yielded, allowing the spike penetrator to fire. In FIG. C the fired spike penetrator 10 moves out of the tube 12 and penetrates the target. In this case the pickup washer 45 contains the spike penetrator 10 keeping the spike penetrator, now embedded in the target, and the lance mine together impeding the target's ability to move. In FIG. D the fired spike penetrator 10 moves out of the tube 12 and penetrates the target. In this case the pickup washer 45 separates from the lance mine tube 12 and continues with the spike penetrator 10 that is now embedded in the target. Optionally the spike penetrator can be tethered to the lance mine by tether 51 to further impede the mobility of the target.

Figure 23:
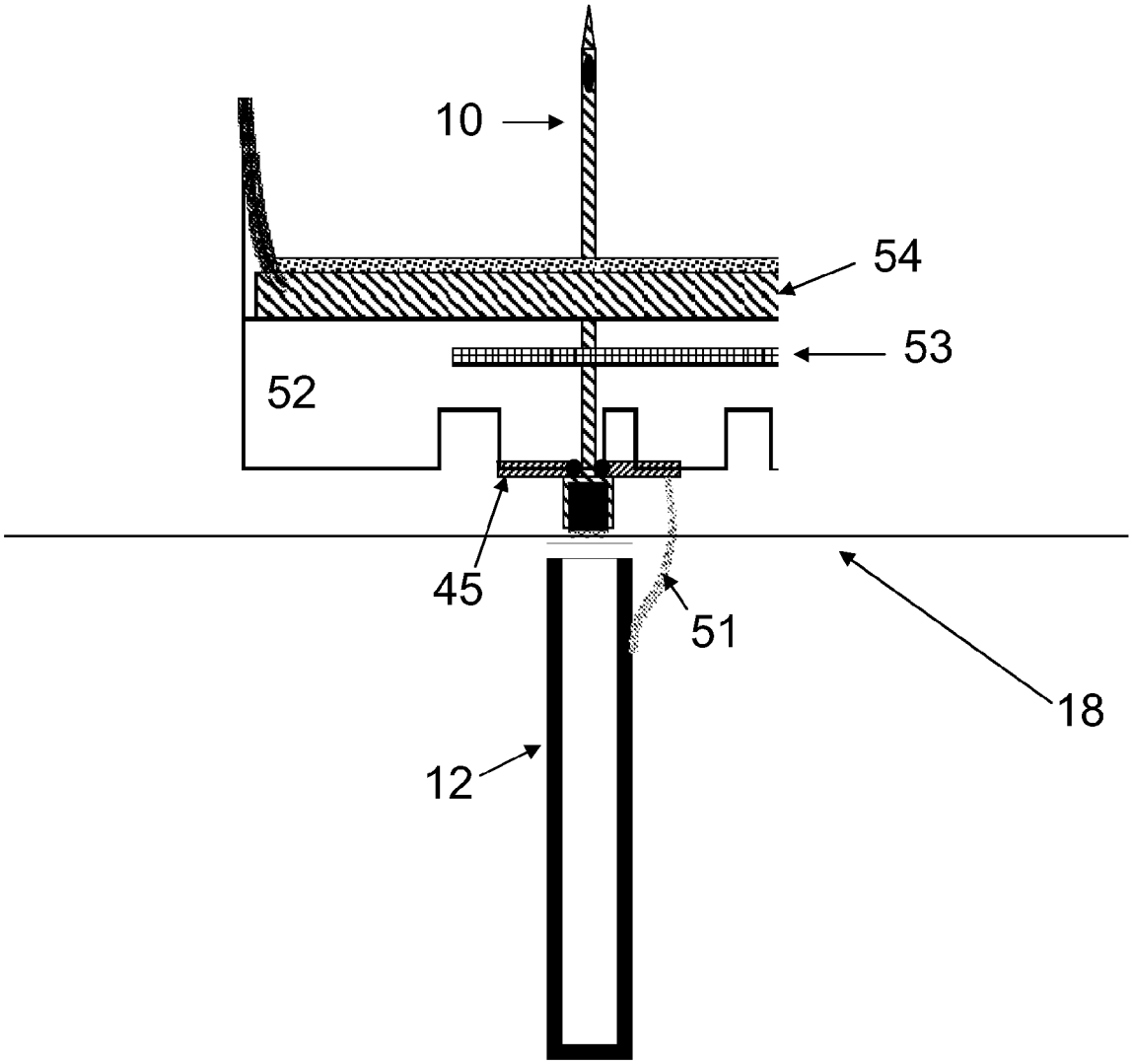
FIG. 23 shows lance mine and spike penetrator with pickup washer and tethering means penetrating an armored boot.

FIG. 23 shows the lance mine after firing and penetrating an armored boot. The tube 12 is in the ground positioned at ground level 18. The spike penetrator 10 has penetrated boot sole 52, boot armor reinforcement 53 and boot inner sole 54. The pickup washer 45 has been captured by spike penetrator 10 and carried against the boot sole 52, stopping the spike penetrator 10 from further penetration. The tether 51 is attaching the tube 12 to the boot sole 52 to impede the mobility of the target.

Figure 24:
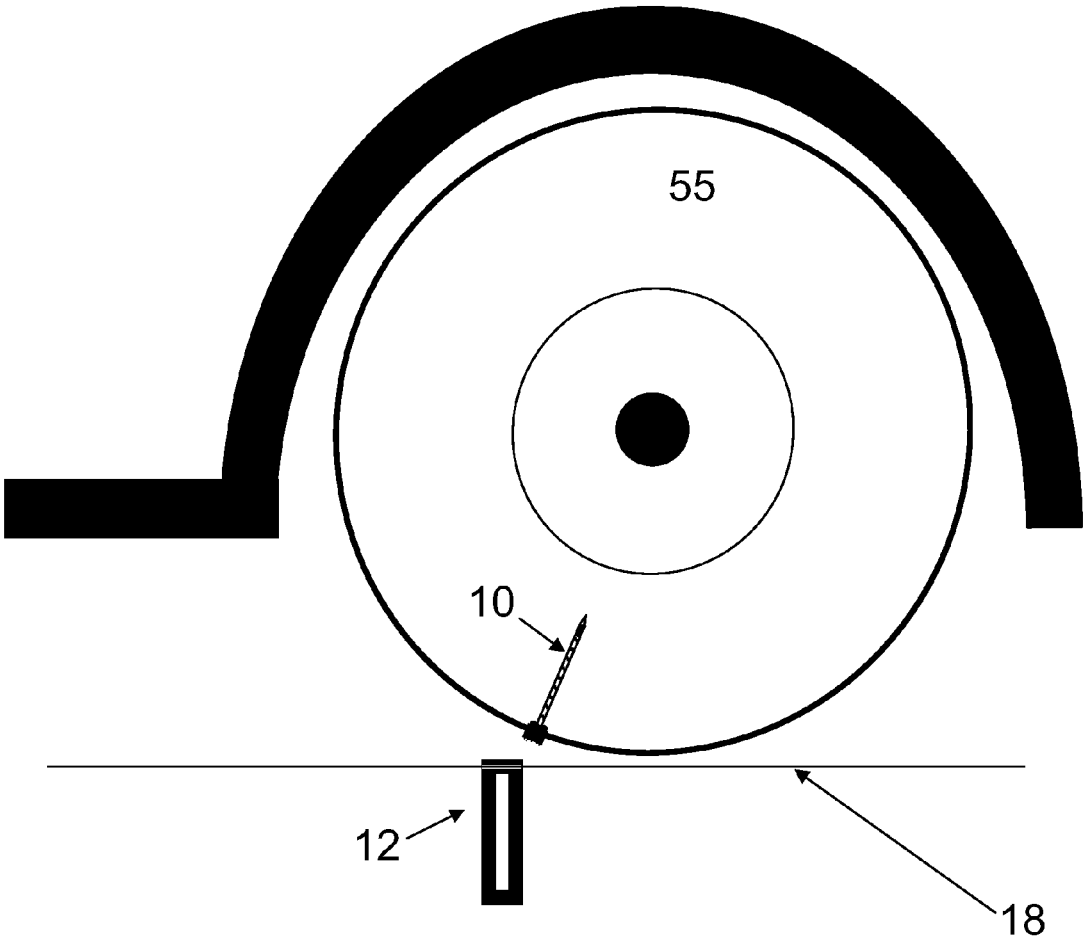
FIG. 24 shows spike penetrator with means for RFID delivery penetrating and lodging in an automotive tire.

FIG. 24 exhibits the action of the lance mine firing the spike penetrator 10 from the ground height 18 mounted tube 12 into a vehicle tire 55. The spike penetrator 10 can be selected to tag the tire with an RFID chip, deflate the tire, keep the tire inflated, deliver chemicals or electronics, or other configurations as desired for the mission.

Figure 25:
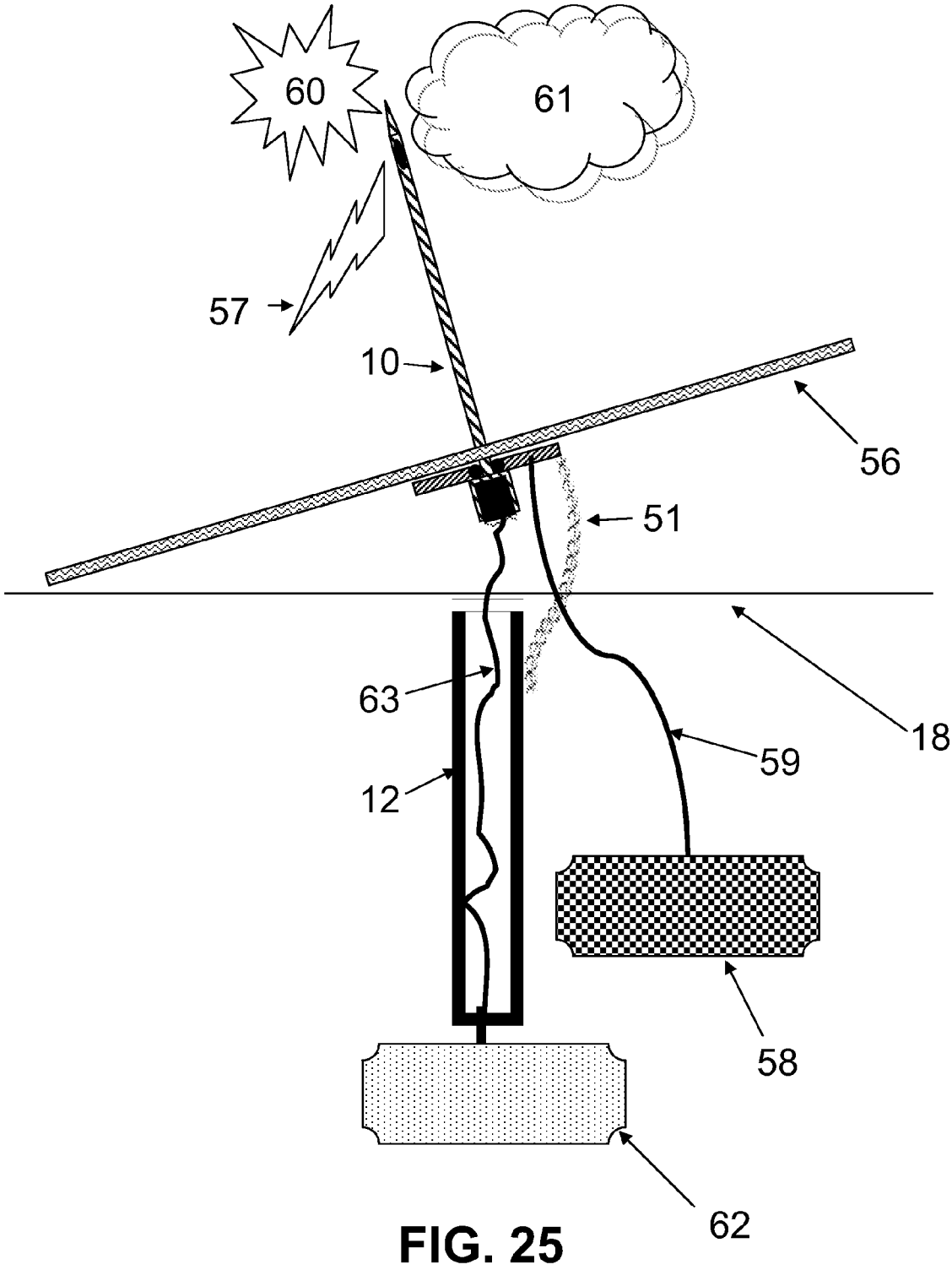
FIG. 25 shows spike penetrator with means for RFID, chemical, electrical and explosive delivery penetrating and lodging in a robots foot, body or tread.

FIG. 25 exhibits the action of the lance mine firing the spike penetrator 10 from the ground height 18 mounted tube 12 into and through a robot's skin 56. The spike penetrator 10 can deliver high voltage and EMP 57 provided by power source 58 and power source cable 59. The spike penetrator 10 can deliver an explosive charge 60 that is either self contained in the spike penetrator 10 or provided by the gas and liquid 61 provided by gas and liquid generator 62 and delivered by delivery tube 63. The gas and/or liquid 61 may be a corrosive, glue, explosive, acid or any combination of chemicals or chemical required for the mission. It is an embodiment of the present invention that the spike penetrator 10 and the lance mine can penetrate a robot's skin and deliver destructive energy and/or materials, and can further tether the robot in place through means of tether 51.

Figures 26, 26A, 26B:
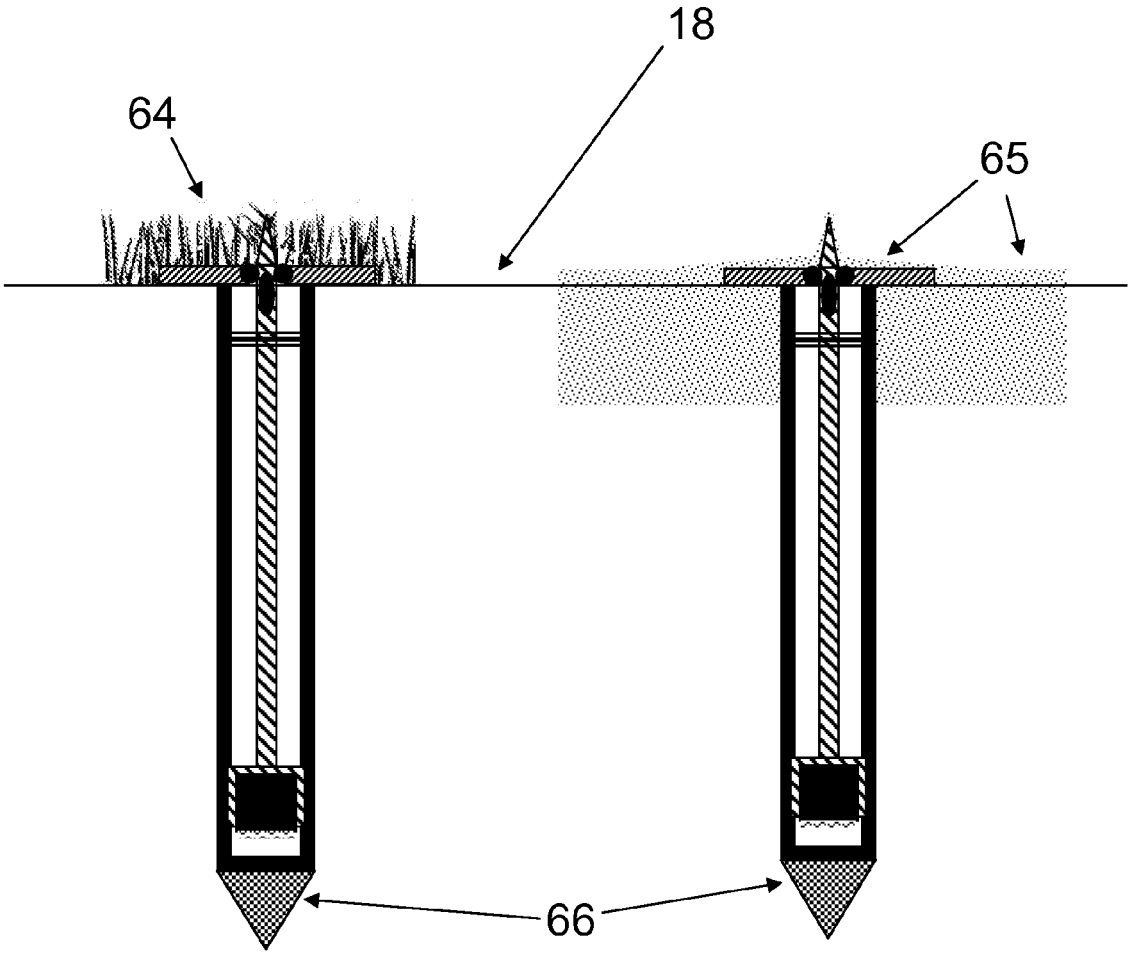
FIG. 26 shows lance mine and spike penetrator with pickup washer, ground penetrator means and self-camouflaging means in a sand and a grassy environment.

FIG. 26 shows two lance mines mounted at ground level. The protruding section of the lance mine at or above ground level 18 is made self camouflaging by coating with a sticky substance such as an adhesive. This provides means for the ground material such as sand, soil, grass or leaves to be blown or otherwise come in contact with the adhesive and stick to the lance mine, effectively camouflaging the lance, and providing means facilitating the lance to be readily camouflaged in any environment. Adhesives of any type may be used including pressure-sensitive adhesives such as acrylate copolymers and contact cements. Water and sun resistant adhesives are preferred. FIG. 26A shows the lance mine in a grassy environment 64 with grasses and other native material sticking to and camouflaging the lance mine. FIG. 26B shows the lance mine in sand 65 with the sand sticking to the exposed parts of the lance mine rendering it camouflaged. Ground spikes 66 facilitate easy ground penetration.

While the present invention has been described in terms of various specific embodiments, those skilled in the art will recognize that the invention can be practiced with considerable modification within the spirit and scope of the following claims.

We claim:

1. The method of an area denial device comprising, a. an enclosure with an opening, b. a lance penetrator contained within an enclosure, c. the lance penetrator protruding from the enclosure opening, d. lance penetrator propellant means within the enclosure, e. an outside object applying force to the tip of the penetrator lance, f. the lance penetrator depressed into the enclosure, g. the propellant initiating, h. the propellant propelling the lance penetrator through the opening, i. the lance penetrator capturing a stop plate on the lance penetrator, j. the lance penetrator impacting and penetrating the outside object, k. the stop plate being brought against the outside object by the penetrator lance, l. the stop plate impacting the outside object, m. the stop plate capturing the lance penetrator, n. the further penetration of the outside object by the lance penetrator being prevented by the stop plate, o. the lance penetrator embedded in the outside object.

2. The method of claim 1 where the lance penetrator carries a Radio Frequency Identification Device (RFID).

3. The method of claim 1 where the area denial device further comprises means to remotely arm and disarm by electronic means including radio signals.

4. The method of claim 1 where the lance penetrator penetrates the outside object, the stop plate has stops further penetration, and a length of the lance penetrator extends from the surface of the stop plate outside the penetrated outside object.

5. The method of claim 1 where the area denial device is deployed by being embedded into the earth from the plane of the stop plate away from the opening, the opening being provided by the stop plate.

6. The method of claim 1 where the lance penetrator is tethered.

7. The method of claim 1 where the force required to initiate the propellant is selectable within a range.

8. The method of claim 1 where the lance penetrator's surface is adhesive.

9. The method of claim 1 further comprising human readable information.

10. The method of claim 1 further comprising a pyrotechnic action after the lance penetrator is propelled thought the opening.

11. The method of claim 1 where the lance penetrator delivers an Electromagnetic Pulse (EMP) to and inside the outside object.

12. The method of claim 1 where the area denial device is air deployed.

13. The method of claim 1 where the area denial device further comprises adhesive camouflaging means.

14. The method of claim 1 where the area denial device is deployed on the earth's surface.

15. The method of claim 1 where the lance penetrator is separable in tension.

* * * * *